US006532882B1

(12) United States Patent
Tajima et al.

(10) Patent No.: US 6,532,882 B1
(45) Date of Patent: Mar. 18, 2003

(54) SEWING MACHINES

(75) Inventors: Ikuo Tajima, Kasugai (JP); Yuichiro Suzuki, Kasuagi (JP); Hirofumi Takagi, Kasugai (JP); Masayoshi Hirate, Kasugai (JP)

(73) Assignee: Tokai Kogyo Mishin Kabushiki Kaisha, Kasugai (JP)

( * ) Notice: Subject to any disclaimer, the term of this patent is extended or adjusted under 35 U.S.C. 154(b) by 0 days.

(21) Appl. No.: 09/926,127

(22) PCT Filed: Oct. 15, 1999

(86) PCT No.: PCT/JP99/05721

§ 371 (c)(1),
(2), (4) Date: Sep. 7, 2001

(87) PCT Pub. No.: WO00/53836

PCT Pub. Date: Sep. 14, 2000

(30) Foreign Application Priority Data

Mar. 9, 1999 (JP) ..... 11-061915
May 10, 1999 (JP) ..... 11-128939
Jun. 11, 1999 (JP) ..... 11-165863

(51) Int. Cl.[7] ..... D05C 9/04
(52) U.S. Cl. ..... 112/103
(58) Field of Search ..... 112/103, 475.11, 112/470.14, 470.18

(56) References Cited

U.S. PATENT DOCUMENTS 5,701,831 A * 12/1997 Morita ..... 112/103
6,019,053 A * 2/2000 Kawaguchi ..... 112/103
6,119,609 A * 9/2000 Kawaguchi et al. ..... 112/103

FOREIGN PATENT DOCUMENTS

| | | |
|---|---|---|
| JP | 61272085 | 12/1986 |
| JP | 2-10154 | 3/1990 |
| JP | 4-40467 | 7/1992 |
| JP | 6257059 | 9/1994 |
| JP | 2563671 | 11/1997 |
| JP | 10-25653 | 1/1998 |

* cited by examiner

*Primary Examiner*—Ismael Izaguirre
(74) *Attorney, Agent, or Firm*—Dennison, Schultz & Dougherty

(57) ABSTRACT

According to the present invention, in a sewing machine, a cylindrical frame for retaining tubular objects is mounted integrally on a cylindrical drive ring that is reciprocally driven in a rotational direction around a cylinder bed and that is linearly reciprocally driven along an axis of the cylinder bed; the drive ring is rotatably supported by a support member that is arranged to contact the outer periphery of the drive ring at three or more positions. By utilizing this construction, not only the drive ring, but also the frame that is mounted thereon may have a small diameter, and the drive ring can be stably supported by the support member so that it smoothly rotates. As a result, the frame can retain tubular objects having a small diameter, such as golf club covers and wrist bands, and a sewing operation, such as an embroidery operation, can be suitably performed along the periphery of the tubular object.

29 Claims, 22 Drawing Sheets

SEWING MACHINES

CROSS-REFERENCE

This application is the US National Stage filing of PCT Application Serial Number PCT/JP99/05721, which PCT application claims priority to Japanese Patent Application Serial Numbers 11-61915, 11-128939 and 11-165863.

TECHNICAL FIELD

The present invention relates to sewing machines that are capable of forming stitches or embroidery on a peripheral surface of a tubular that will be sewn (tubular objects), and in particular, a tubular article that has a small diameter.

RELATED ART

Conventionally, if an embroidering operation or the like is performed on the periphery of a tubular object, such as a cap having a large diameter, a tubular frame having a large diameter is also used to support the tubular object. However, the tubular object may also have a small diameter, such as a cover for a golf club or a wrist band. If a sewing operation is performed on such a tubular object having a small diameter, the frame that supports the object also must have a small diameter. The frame is mounted on a drive ring that reciprocally moves in both linear and rotational directions, and the frame is operated to linearly move and to rotate around a cylinder bed by the actuation of the drive ring during the sewing operation. The cylinder bed includes a shuttle disposed therein, and a throat plate having a needle hole is secured to the upper surface of the cylinder bed by means of screws or the like in a position opposing the shuttle.

It is very difficult to position the aforementioned drive ring and the frame having a small diameter as near as possible to the outer peripheral surface of the cylinder bed and still support the drive ring, such that the drive ring can stably rotate. In addition, when such a small frame rotates together with the tubular object around the cylinder bed during the sewing operation, the tubular object (interlining) may be caught and block the edge of the throat plate or the boss portion of the needle hole that protrudes from the surface of the throat plate. As a result, it is difficult to suitably perform a sewing operation, such as an embroidery operation, on small tubular objects, such as golf club covers and wrist bands.

Further, in order to perform the sewing operation over a wide range in the circumferential direction of the tubular object, it is necessary to provide a frame having a wide sewing window; further, an interlining is required to support the tubular object, such that the tubular object does not sink into the sewing window. Because the interlining is intended to support the tubular object along the wide sewing window, a paper material or a non-woven fabric, which has a suitable thickness and rigidity, is used as the interlining.

In order to retain a tubular object and its interlining on the frame, the tubular object is placed on the frame together with the interlining, which is positioned inside of the tubular object, and the tubular object is retained to thereby retain the interlining. However, in operation, it is difficult to handle the tubular object together with the interlining, and it is difficult to stably retain the tubular object because the interlining may slip off the sewing window of the frame.

SUMMARY OF THE INVENTION

It is an object of the present invention to enable a drive ring to smoothly and stably rotate, while disposing the driver ring and a frame having a small diameter as near as possible to an outer peripheral surface of a cylinder bed.

It is another object of the present invention to prevent a tubular object from being caught by an edge of a throat plate or the like during rotation of the frame together with the tubular object around the cylinder bed, so as to enable an embroidery operation or similar operation to be performed over a wide range in the circumferential direction of the tubular object that has a small diameter.

It is a further object of the present invention to individually hold a tubular object and its interlining against the frame so as to facilitate the sewing operation and to also enable a frame having a small diameter and a wide sewing window to be stably held.

According to one aspect of the present invention, in a sewing machine, a cylindrical frame for holding tubular objects is mounted integrally on a cylindrical drive ring that is reciprocally driven in a rotational direction around a cylinder bed and that is linearly reciprocally driven along an axis of the cylinder bed. The cylindrical drive ring is rotatably supported by a support member that is arranged to contact the outer periphery of the drive ring at three or more positions.

By utilizing this construction, not only the drive ring, but also the frame that is mounted thereon, may have a small diameter, and the drive ring can be stably supported by the support member so that the drive ring will smoothly rotate. As a result, the frame can retain a tubular object having a small diameter, such as a golf club cover or a wrist band, and a sewing operation, such as an embroidery operation, can be suitably performed on the periphery of the tubular object.

According to another aspect of the present invention, the diameter of the drive ring is selected such that the inner periphery of the drive ring is disposed as near as possible to the outer peripheral surface of the cylinder bed.

Additional embodiments taught for stably rotating the drive ring. Thus, in another aspect of the present invention, the drive ring is rotatably supported by a support member against a plate that is linearly reciprocally moved along the axis of the cylinder bed. Further, the drive ring is constructed such that it is reciprocally moved in the rotational direction around the cylinder bed by means of a cable, which is wound about the drive ring. In addition, the support member comprises three or more rollers that are rotatably supported on the plate.

In another aspect of the present teachings, the cylinder bed includes a shuttle disposed therein, a needle hole provided in a position opposing the shuttle, and a support arranged to provide an internal support for the tubular object retained by the frame. The support includes a receiver portion that extends at least in the vicinity of the needle hole along an arc, which arc is substantially coaxial with the rotational axis of the frame.

Therefore, the tubular object can be supported in an arc shaped configuration by the receiver portion of the support at least in the vicinity of the needle hole, so that the tubular object may not be caught by cylinder, bed-side parts during rotation of the frame around the cylinder bed. As a result, tubular objects having small diameters also can be properly mounted and can be suitably sewn over a wide range in the circumferential direction.

In another aspect of the present invention, the support includes the receiver portion and a joint portion, and the support is integrated with the cylinder bed by means of the joint portion. Further, the arc-shape of the receiver portion includes a cylindrical shape about an axis that is coaxial with the rotational axis of the frame. In addition, the outer peripheries of both ends of the receiver portion are formed as tapered surfaces so as to provide a smooth guide for the tubular object.

In particular, by configuring the receiver portion to have a cylindrical configuration and by forming the outer peripheries of both ends of the receiver portion as tapered surfaces, it is almost impossible for the tubular object and its interlinings to be caught during the sewing operation.

In another aspect of the present invention, the frame includes a tubular receiver frame that can be positioned on the outer periphery of the tubular object, a sewing window opens within the receiver frame over a predetermined range, and the tubular object and its interlining can be individually retained in the area of the sewing window.

In particular, although a wide sewing window is needed for a small receiver frame if small tubular objects are to be processed, and if a sewing operation, such as an embroidering operation, is performed on the object over a wide range in the circumferential direction, it is possible for the interlining to be first retained in the area of the sewing window and the tubular object is thereafter retained. In this case, these operations can be easily performed and it is possible to stably retain the articles to be sewn.

In another aspect of the present invention, the sewing window opens on both the upper and lower sides of the receiver frame, and the sewing machine is constructed such that the tubular object and the interlining can be individually retained by each of the areas of the sewing window.

Therefore, the tubular object and the interlining can be sewn individually within the areas of the sewing windows without the need to reset the tubular object and the interlining on the frame; thus, operation efficiency can be improved.

In another aspect of the present invention, the frame includes a presser frame for holding a tubular object against the receiver frame and includes a presser frame for holding an interlining, thereby enabling the tubular object and the interlining to be individually retained as described above.

Additional embodiments relate to the presser frames. Thus, in another aspect of the present invention, one end of each of the presser frames is pivotally connected to the receiver frame. The sewing machine is constructed such that the presser frame for the interlining is laid over the presser frame for tubular objects. In addition, the presser frame for supporting the tubular objects includes a lock member that can engage the receiver frame. Therefore, both presser frames can be retained against the receiver frame by engaging the presser frame for supporting the tubular objects against the receiver frame by means of the lock member.

In another aspect of the present teachings, one of the presser frames can be set on the receiver frame with the interlining being retained therebetween. The other of the presser frames can be set on the former presser frame with the tubular object being retained therebetween.

In another aspect of the present teachings, the receiver frame includes a spring member for holding the interlining, and further the presser frame is wound around the receiver frame so as to be set on the receiver frame and to hold the tubular object. Further, the presser frame includes a flexible frame, which has a window, which is sized to correspond to the sewing window of the receiver frame, and connecting strips that are connected to both sides of the flexible frame. In addition, a slip prevention member is disposed around the sewing window of the receiver frame. A pressing member is disposed around the window of the flexible frame so as to correspond to the slip prevention member, which is disposed around the sewing window. Therefore, the construction for holding the tubular object and its interlining against the receiver frame can be simplified.

Additional features, aspects and advantages of the present invention will be become more fully apparent by reading the following description in conjunction with the drawings.

EMBODIMENTS OF THE INVENTION

Embodiments of the present invention will now be described with reference to the drawings.

A first embodiment of the present invention will be described with reference to FIGS. 1 to 8.

Figure 1:
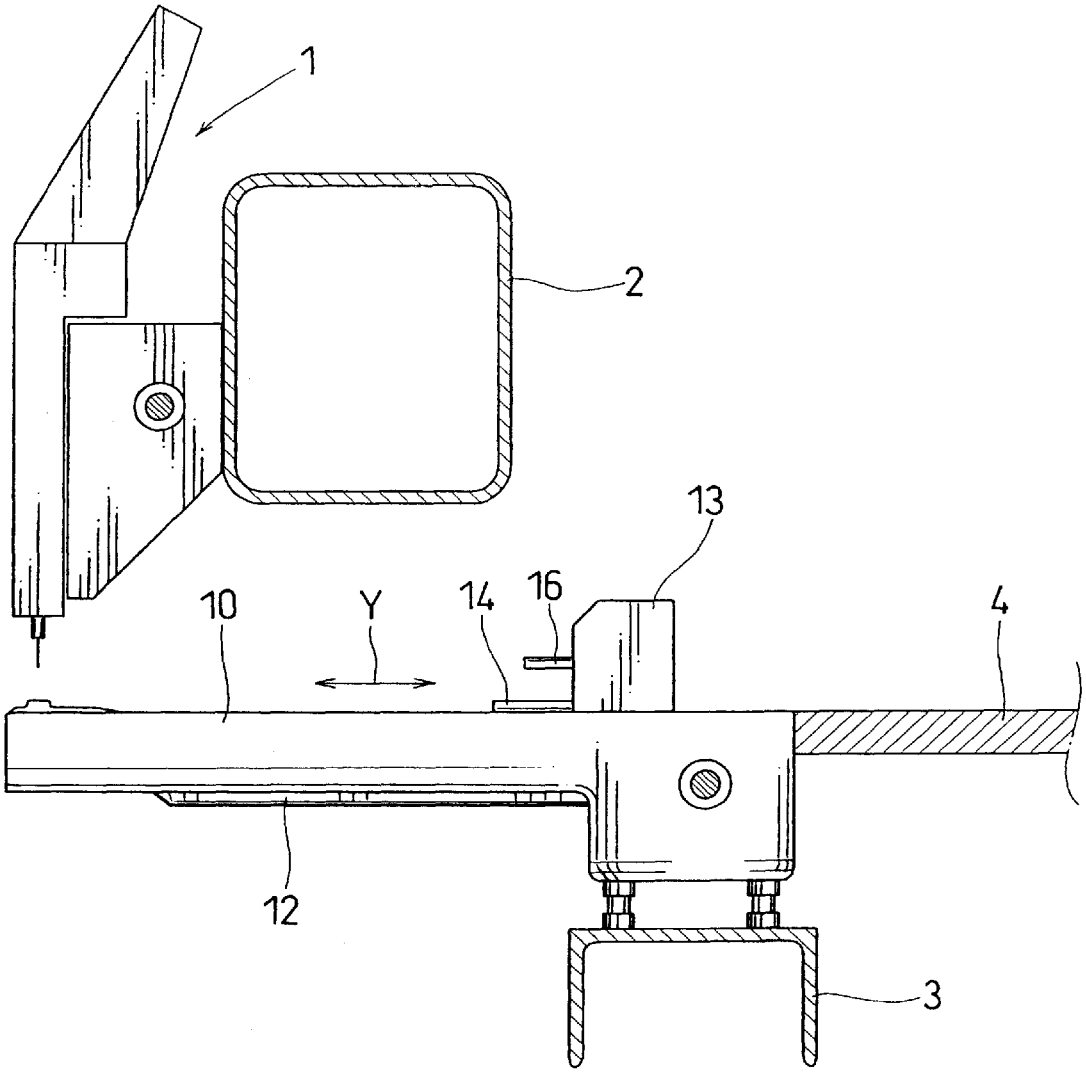
FIG. 1 is a side view schematically showing a sewing machine.

FIG. 1 is a side view that schematically shows a sewing machine, in which a sewing head 1 is disposed on the front side of a machine frame 2; the machine frame 2 supports the sewing head 1. In the case of a multi-head sewing machine, a plurality of sewing heads may be disposed on the machine frame 2. A cylinder bed 10 is disposed at a position below the sewing head 1 and has a base that is supported by the upper surface of a leg structure 3; adjustment is made so that the upper surface of the cylinder bed 10 and the upper surface of the machine table 4 extend substantially in parallel with each other. A drive section 13 is arranged so that it can reciprocally move along these upper surfaces in the direction of arrow Y as shown in FIG. 1; the drive section 13 includes two joint plates 14 and 16.

Figure 3:
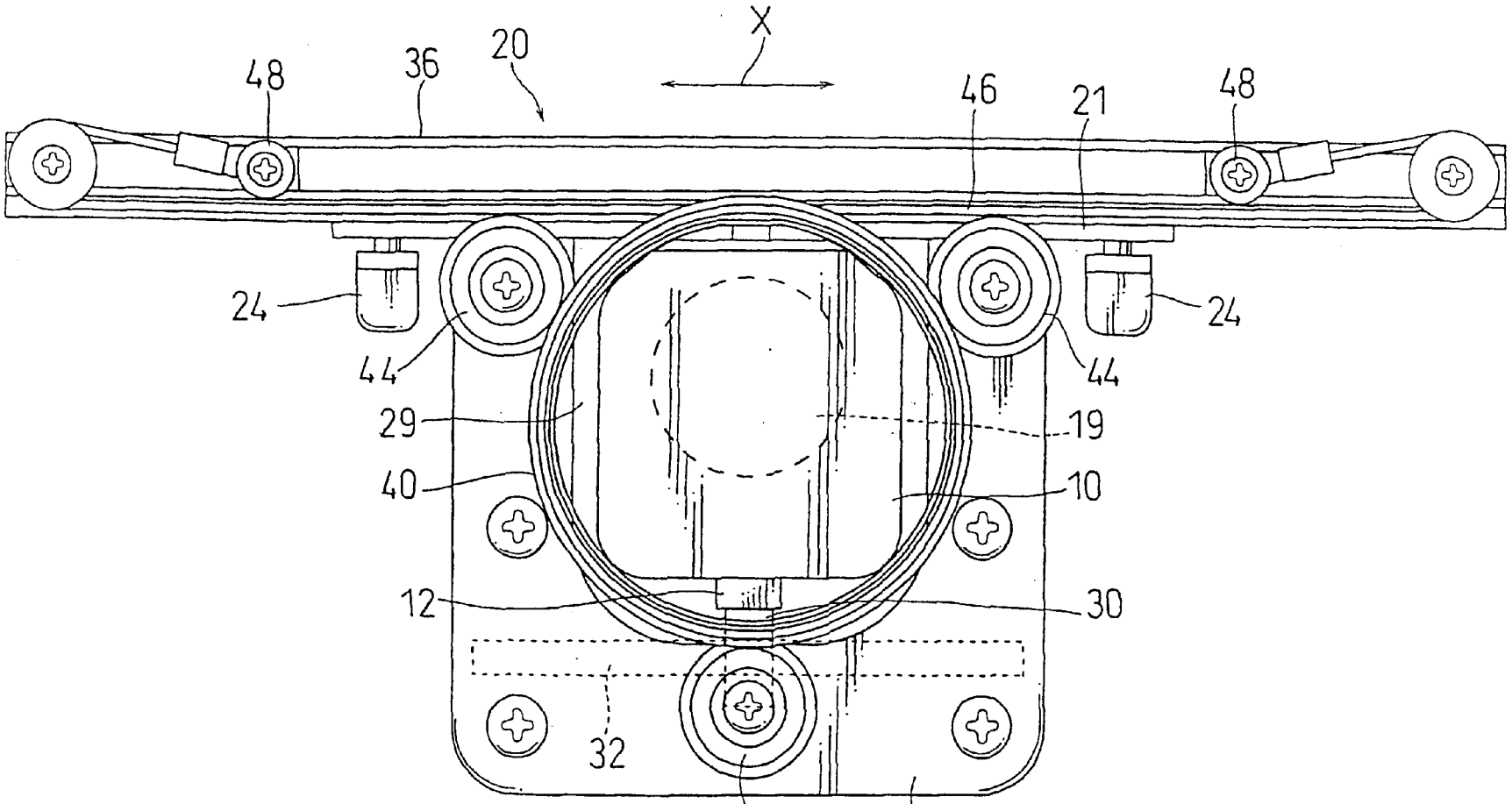
FIG. 3 is a front view of FIG. 2.

The drive section 13, which includes the joint plates 14 and 16, has a predetermined length in the direction that is perpendicular to arrow Y (i.e., in the direction of arrow X that is shown in FIG. 3). One of the joint plates 14 is integral with the drive section 13, while the other of the joint plates 16 is supported such that it can move in the direction of arrow X relative to the drive section 13. The drive section 13 may reciprocate together with the joint plates 14 and 16 in the direction of arrow Y by means of a drive source, such as a motor (not shown) that is disposed below the table 4. In addition, the joint plate 16 may reciprocate in the direction of arrow X by means of a drive source, such as a motor (not shown), via a belt or a wire.

Figure 2:
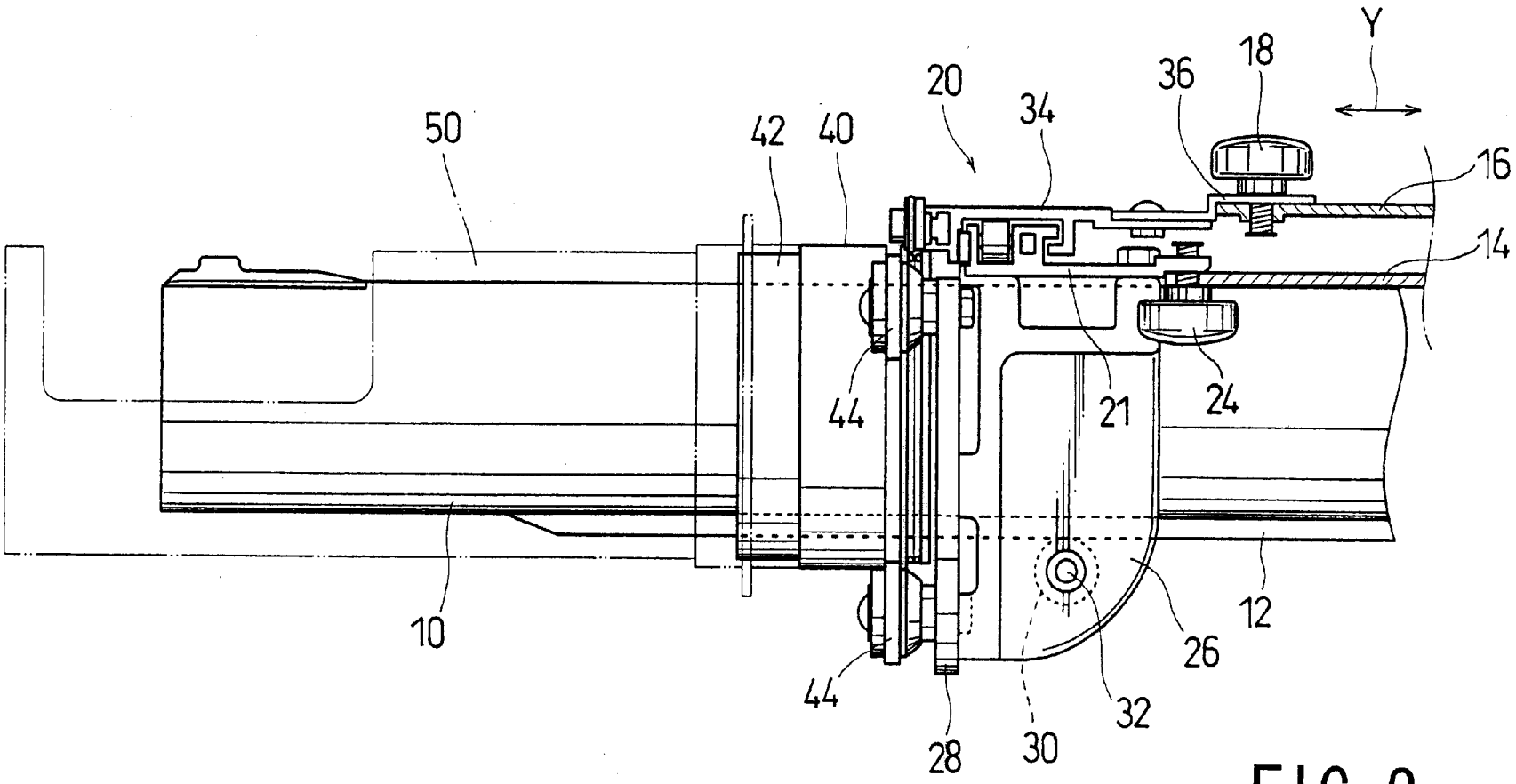
FIG. 2 is a side view showing the mounting state of a frame drive unit according to a first embodiment.
Figure 4:
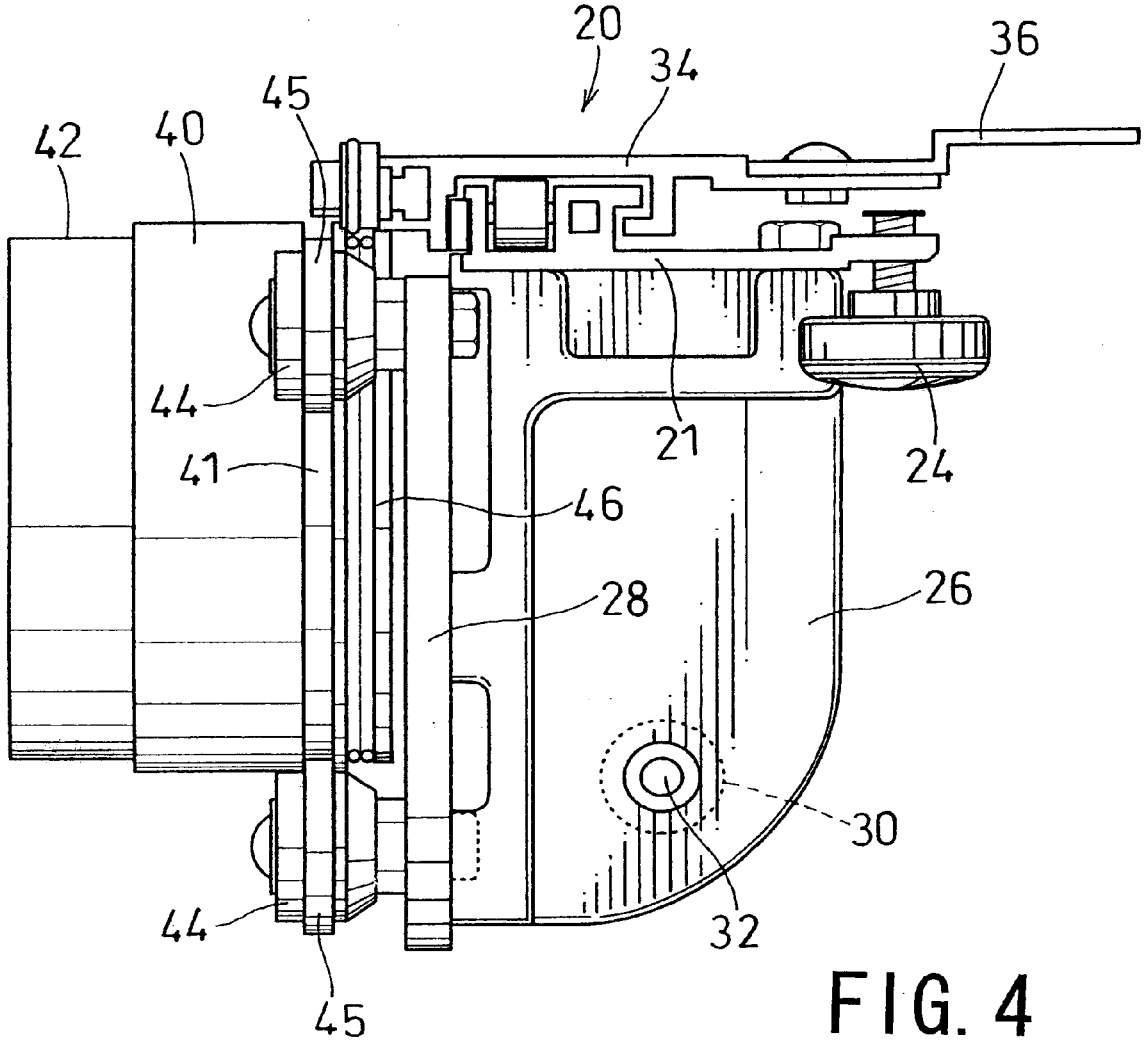
FIG. 4 is a side view showing only the frame drive unit of the first embodiment in an enlarged scale.
Figure 5:
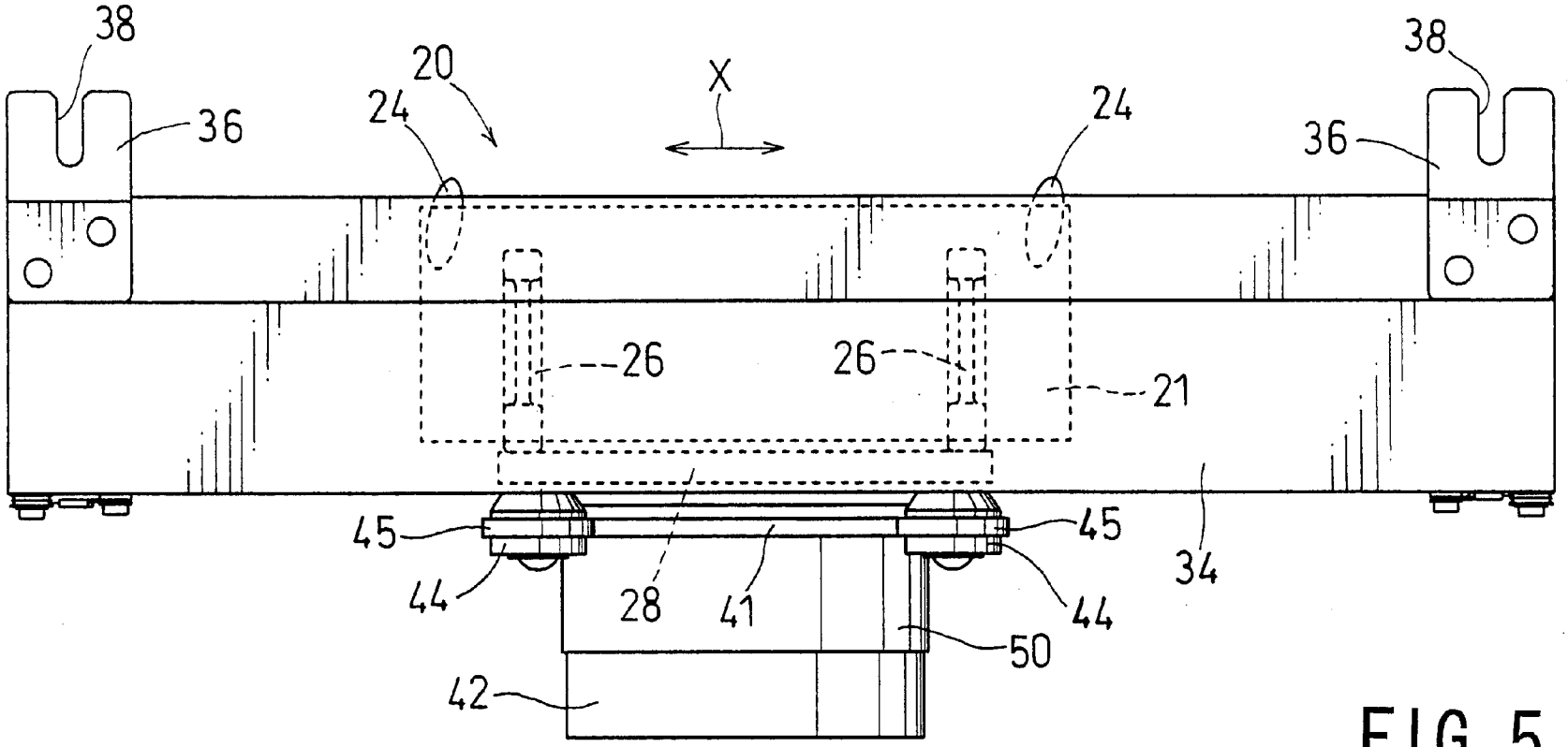
FIG. 5 is a plan view of FIG. 4.

FIG. 2 is a side view showing, in an enlarged scale, a frame drive unit 20 mounted on a part of the cylinder bed 10 and FIG. 3 shows a front view of FIG. 2. FIG. 4 shows a side view of only the frame drive unit 20 in an enlarged scale, and FIG. 5 is a plan view of FIG. 4. As will be understood from these figures, a shuttle 19 is disposed together with its associated drive mechanism (not shown) within the cylinder bed 10 at a position that is adjacent to the front end of the cylinder bed 10 (FIG. 3). In addition, a rail 12 is formed centrally on the lower surface of the cylinder bed 10 and extends in the longitudinal direction of the cylinder bed 10.

The frame drive unit 20 is mounted on the outer side of the cylinder bed 10, so that it can reciprocally move along the longitudinal direction of the cylinder bed 10 (i.e., in the direction of arrow Y). The frame drive unit 20 has a support plate 21 that includes a rear portion, and screws 24 are non-removably mounted on both sides of the support plate 21. The frame drive unit 20 also has a slide plate 34 that is mounted on the upper surface of the support plate 21, such that the slide plate 34 can slide relative to the support plate 21 in the direction X as indicated in FIGS. 3 and 5; the slide plate is prevented from being removed from the support plate 21. Joint members 36 are fixed to and disposed on both respective sides of the rear end of the slide plate 34.

The support plate 21 is attached to the joint plate 14 by tightening both screws 24 with the shanks of the screws 24 positioned within respective notches (not shown) formed in the joint plate 14. The slide plate 34 is attached to the other joint plate 16 by tightening screws 18, which screws 18 are non-removably mounted on their respective joint members 36, with the shanks of the screws 18 positioned within notches 38 (FIG. 5) formed in the respective joint members 36.

Brackets 26 are secured to the lower surface of both the right and left sides of the support plate 21, and a plate 28 is secured to the front surfaces of the brackets 26. Both ends of a roller shaft 32, which has a roller 30, are supported by the brackets 26 by means of support portions (not shown) that function to adjust the position in the vertical direction. The support portions of the roller shaft 32 may be adjusted with respect to the brackets 26, such that the roller 30 contacts the lower surface of the rail 12, thereby preventing backlash of the frame drive unit 20 relative to the cylinder bed 10. In addition, the plate 28 includes an opening 29 through which the cylinder bed 10 extends without interference (FIG. 3); three support rollers 44 are supported on the front surface of the plate 28 and are spaced at equal angles from each other; thus, the rollers 44 can rotate independently.

A cylindrical drive ring 40 is disposed inwardly of the support rollers 44 so as to freely rotate. As will be understood from FIG. 4, each of the support rollers 44 has a flange-shaped, large diameter portion 45 that engages an annular recess 41 formed within the outer peripheral surface of the drive ring 40 at a position adjacent to the rear end of the drive ring 40. Therefore, the drive ring 40 is fixed in position in the axial direction, but it can rotate about its axis. Alternatively, the concave-to-convex relationship of the annular recess 41 of the drive ring 40 and the large diameter portions 45 of the support rollers 44 can be interchanged. In addition, the support rollers 44 may be replaced with members other than rollers (rotary members), and the number of support positions for the outer periphery of the drive ring 40 may be increased to four or more.

A cable 46 is wound around the outer periphery of the drive ring 40 at a position closer to the rear end than the annular recess 41. Attachments 48 are secured to both ends of the cable 46 and are respectively bolted to the front portion of the slide plate 34 (FIG. 3). In alternative of wire cables, timing belts may be used instead of the cable 46.

As indicated by dotted lines in FIG. 2, a frame 50 may be mounted on the drive ring 40 and may be adapted to retain tubular articles to be sewn (tubular objects). The entire frame drive unit 20 may reciprocate in the direction of arrow Y by a Y-drive command according to frame drive data for the sewing machine; the slide plate 34 may be moved in the direction of arrow X relative to the other parts of the unit by an X-drive command. Therefore, the drive ring 40 may linearly move together with the frame 50 in the direction of arrow Y and may rotate about an axis of the linear movement. As a result, a sewing operation, such as an embroidery operation, can be performed on the periphery of the tubular object that is set on the frame 50.

Because the support rollers 44 are disposed on the outer side of the drive ring 40 and rotatably support the drive ring 40, the diameter of the drive ring 40 can be reduced to be as near as possible to the outer peripheral surface of the cylinder bed 10. Therefore, the diameter of the frame 50 may be reduced and may sufficiently handle tubular objects, even if the tubular objects have a small diameter, such as golf club covers and wrist bands. The cable 46, such as a wire cable or a timing belt, for converting the linear movement of the slide plate 34 into rotational movement of the drive ring 40 may be replaced with other transmission means, such as gears. In addition, in the case of a multi-head sewing machine, a motor may be provided for the frame drive unit 20 of each cylinder bed 10 in order to drive the drive ring 40, so that thc drive ring 40 of each frame drive unit 20 can be independently driven.

Figure 6:
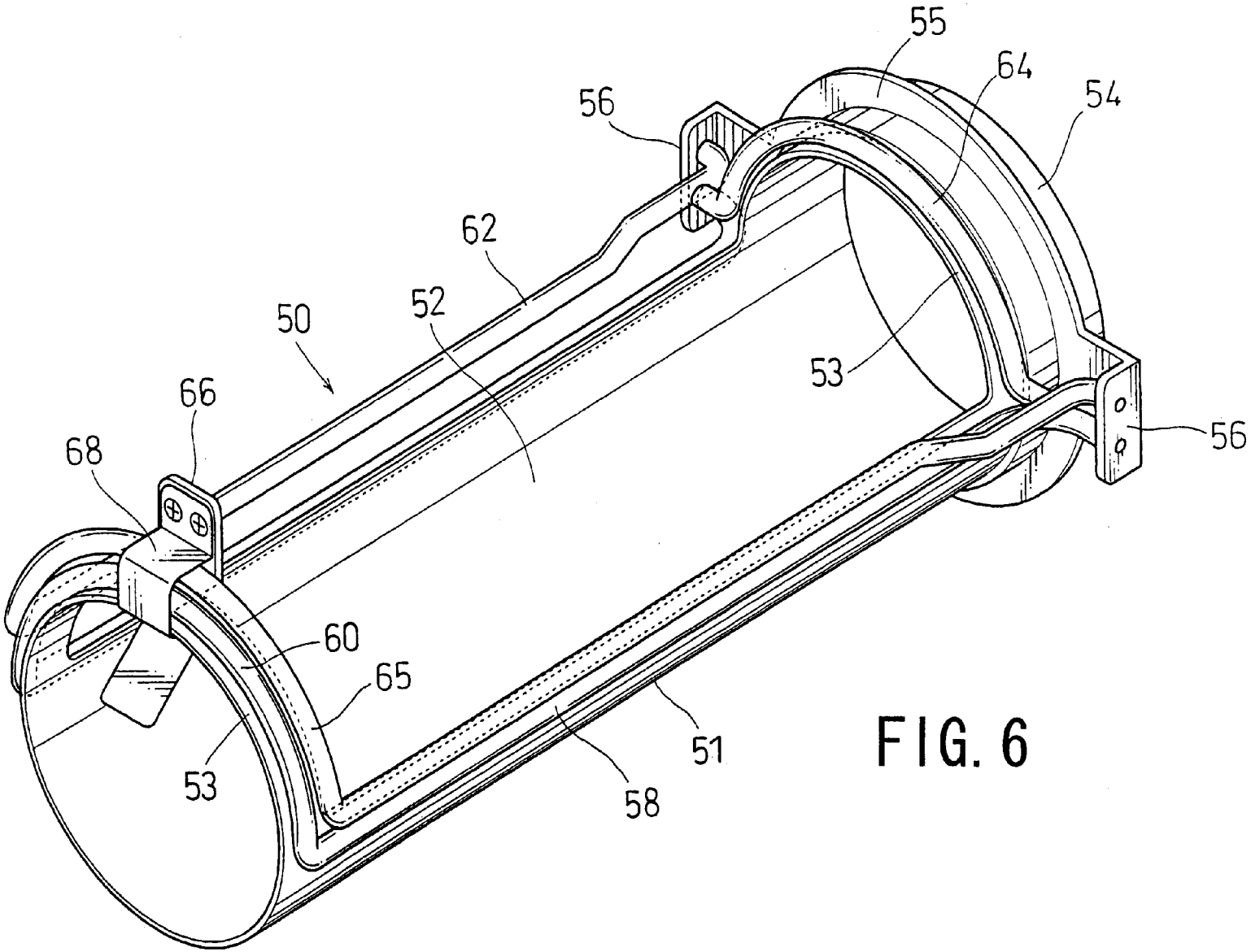
FIG. 6 is a perspective view showing the appearance of the frame of the first embodiment.
Figure 7:
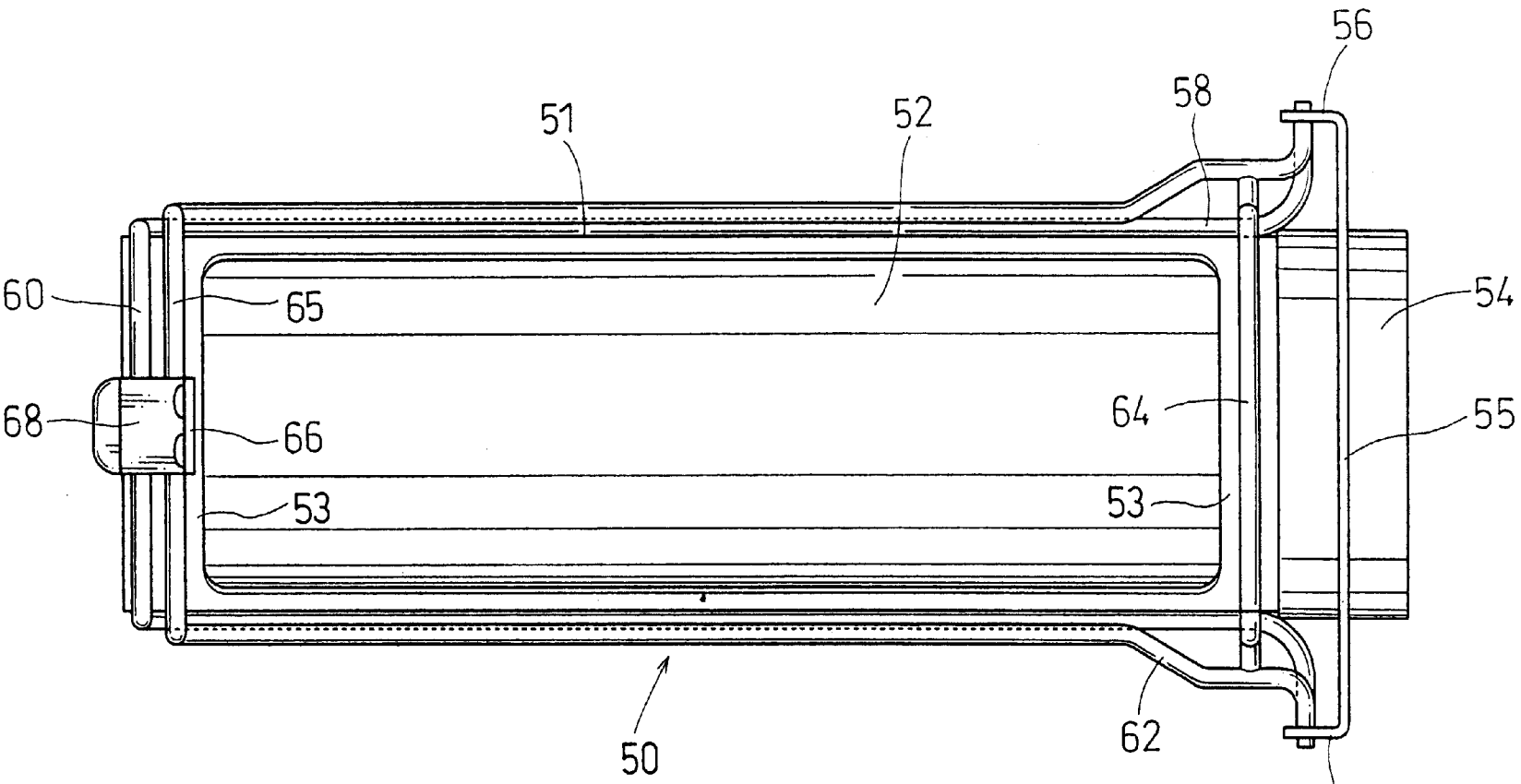
FIG. 7 is a plan view of the frame of the first embodiment.
Figure 8:
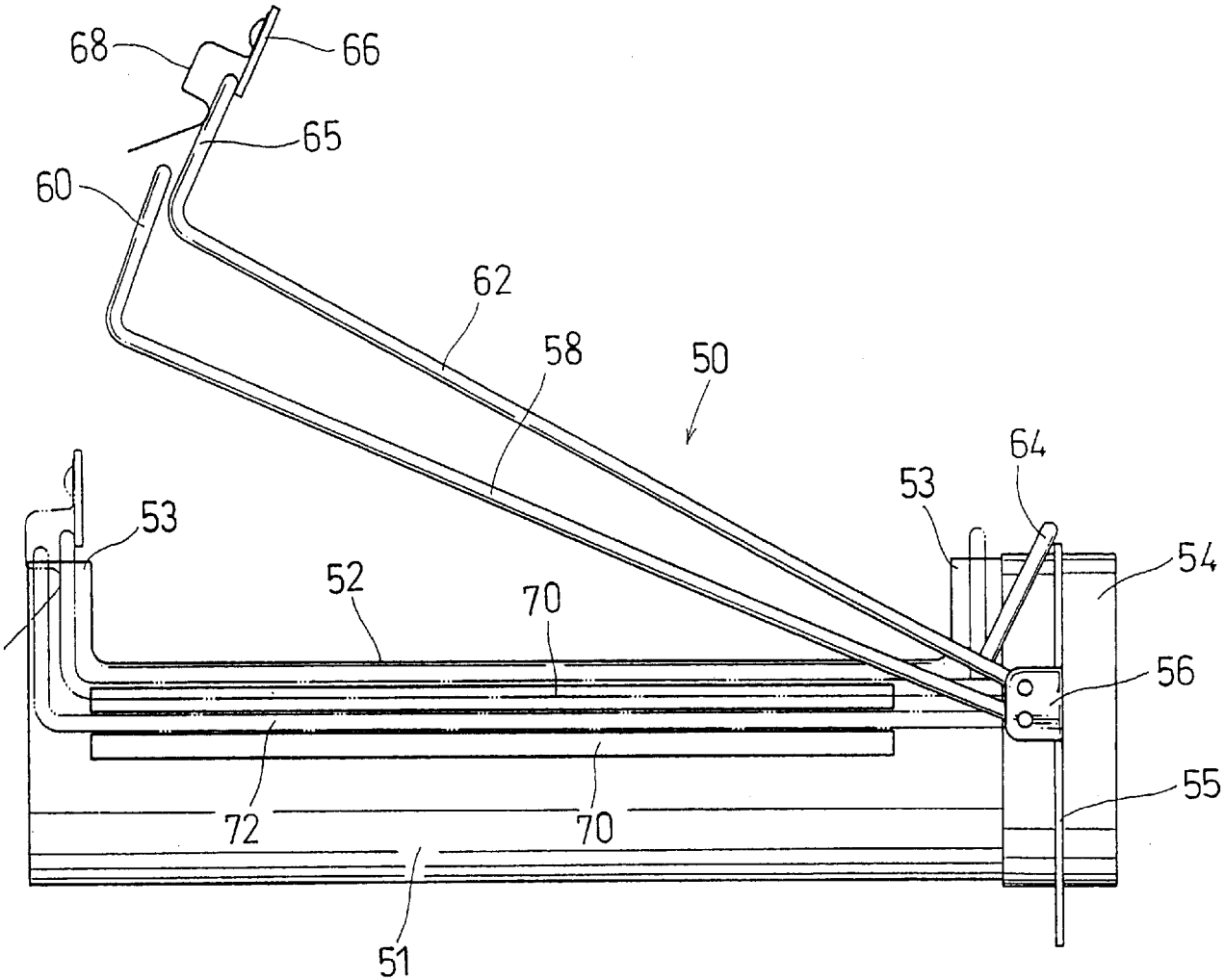
FIG. 8 is a side view of FIG. 7.

FIG. 6 is a perspective view showing the appearance of frame 50 for retaining tubular objects, FIG. 7 is a plan view of the frame 50, and FIG. 8 is a side view of FIG. 7. As will be understood from these figures, the frame 50 generally comprises a receiver frame 51, a presser frame 58 for an interlining, and a presser frame 62 for a tubular object.

The receiver frame 51 has a cylindrical configuration, so that it can be positioned around the outer peripheral surface of the cylinder bed 10; a sewing window 52, which opens over substantially the upper half in the circumferential direction of the receiver frame 51, is formed within a portion of the receiver frame 51 and is surrounded by annular portions 53 that. are provided at both ends of the receiver frame 51. The inner periphery of a base end portion of the receiver frame 51 is selected to have a size that enables this portion to be mounted on a small-diameter portion 42 of the drive ring 40, so that the frame 50 can be integrated with the drive ring 40 by this mounting operation. Illustration is omitted with respect to parts for locking the mounting state or parts for restraining the position of the receiver frame 51 about an axis thereof relative to the small-diameter portion 42 of the drive ring 40. A retainer 54 having a flange 55 is secured to the outer periphery of the base end portion of the receiver frame 51; support portions 56 are positioned on opposite sides of the retainer 54 and extend integrally from the flange 55.

As shown in FIG. 8, two retainer plates 70 are secured to each side (only one side is shown in the figure) of the receiver frame 51 and extend in parallel with each other along opening edges of the sewing window 52. A recess 72 is formed between these retainer plates 70 so as to receive either one of side portions of the presser frame 58 for interlinings.

The presser frames 58 and 62 are formed individually by bending metal cylindrical bars or cylindrical pipes into frame configurations; end portions of these frames are pivotally 95 connected to both support portions 56, such that the presser frame 62 for tubular objects can be laid over the presser frame 58 for interlinings. The respective presser frames 58 and 62 have arc-shaped portions 60 and 65 at a position opposing the front annular portion 53 of the receiver frame 51.

The arc-shaped portion 60 of the presser frame 58 for interlinings is sized to contact the outer periphery of the front annular portion 53 of the receiver frame 51. Furthermore, an upright support 66 is fixed to the middle of the arc-shaped portion 65 of the presser frame 62 for tubular objects. A lock member 68 includes a leaf spring and is mounted on the support 66. For example, the lock member 68 can engage the inner periphery of the front end of the receiver frame 51, as shown in FIG. 6, to thereby hold both presser frames 58 and 62, as shown in FIG. 6. The presser frame 62 further includes an arc-shaped portion 64 at a position opposite to the annular portion 53 that is disposed at the base end side of the receiver frame 51.

The operation of the frame 50 will now be described. First, both presser frames 58 and 62 are positioned to be raised relative to the receiver frame 51, as indicated by solid lines in FIG. 8. In this state, an interlining for a tubular object (not shown) is first placed on the receiver frame 51 such that the interlining covers the sewing window 52; thereafter, the presser frame 58 is pivoted downward to the position that is indicated by dotted lines in FIG. 8 (i.e., the position shown in FIGS. 6 and 7). As a result, the side portions of the presser frame 58 are fitted into each of the recesses 72, which are formed between the respective retainer plates 70, and both ends of the interlining are clamped, so that the interlining can be secured against the frame 50.

Then, the tubular object is placed on the receiver frame 51 so as to cover the outer periphery of the receiver frame 51 (also with the interlining); then, the presser frame 62 is pivoted downward to the position that is indicted by dotted lines in FIG. 8 (i.e., the position shown in FIGS. 6 and 7). As a result, the lock member 68 engages the inner periphery of the front portion of the receiver frame 51, so that the tubular object can be retained against the outer periphery of the receiver frame 51.

The interlining serves to support the tubular object so as to prevent the tubular object from sinking into the sewing window 52, if the tubular object is made of a fabric, synthetic leather or the like and is set on the receiver frame 51. Therefore, the size of the interlining is sufficient if it is slightly larger than the size of the sewing window 52; a paper material or a non-woven fabric made of resin having a suitable thickness and rigidity may be used as the interlining material.

The sewing operation can be performed over the entire periphery of the tubular object by providing the sewing window 52 around nearly 360° in the circumferential direction of the receiver frame 51. If the tubular object is made of a sturdy material, the front annular portion 53 of the receiver frame 51 may hold it; in this case, the sewing window 52 may be omitted from the receiver frame 51.

Figure 9:
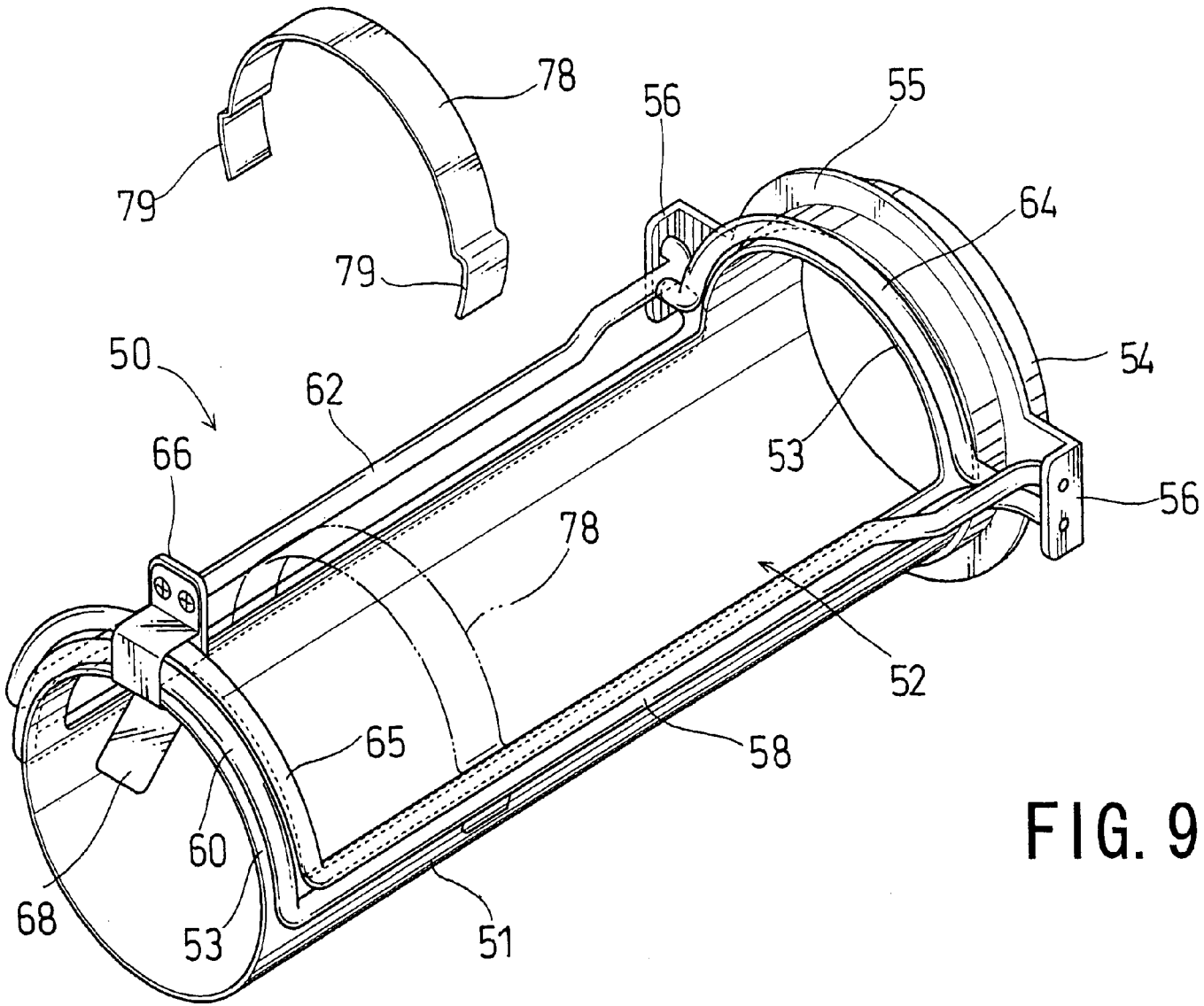
FIG. 9 is a perspective view of an alternative embodiment of the frame of the first embodiment.

An auxiliary frame 78 is shown in FIG. 9, which shows a perspective view of the frame 50 in the same manner as FIG. 6, and is adapted to be used for tubular objects that have narrow areas for a sewing operation, such as an embroidery operation. The auxiliary frame 78 is made of a resilient material, such as metal or resin, and is formed in an arc-shaped configuration with a curvature that is substantially the same as the annular portion 53 of the receiver frame 51. Legs 79 are formed on both ends of the auxiliary frame 78 and are adapted to mount the auxiliary frame 78 on the receiver frame 51. In order to use the auxiliary frame 78, both presser frames 58 and 62 are brought to raised positions, and both legs 79 are mounted on the edges of the sewing window 52, so that the legs 79 resiliently clamp the edges from their outer sides.

By using the auxiliary frame 78, the tubular object (interlining) can be supported in a suitable position in the area of the sewing window 52. The mounting position of the auxiliary frame 78 can be freely adjusted in response to the area for the embroidering operation that will be performed on the tubular object. In addition, it is possible to attach a slip-prevention member, such as a rubber plate, to the outside surface of the auxiliary frame 78 or the surface that may contact the interlining 76.

A second embodiment will now be described with reference to FIGS. 10 to 13. The second embodiment is directed to a construction in which a separate support 80 is mounted on the front portion of the cylinder bed 10.

Figure 10:
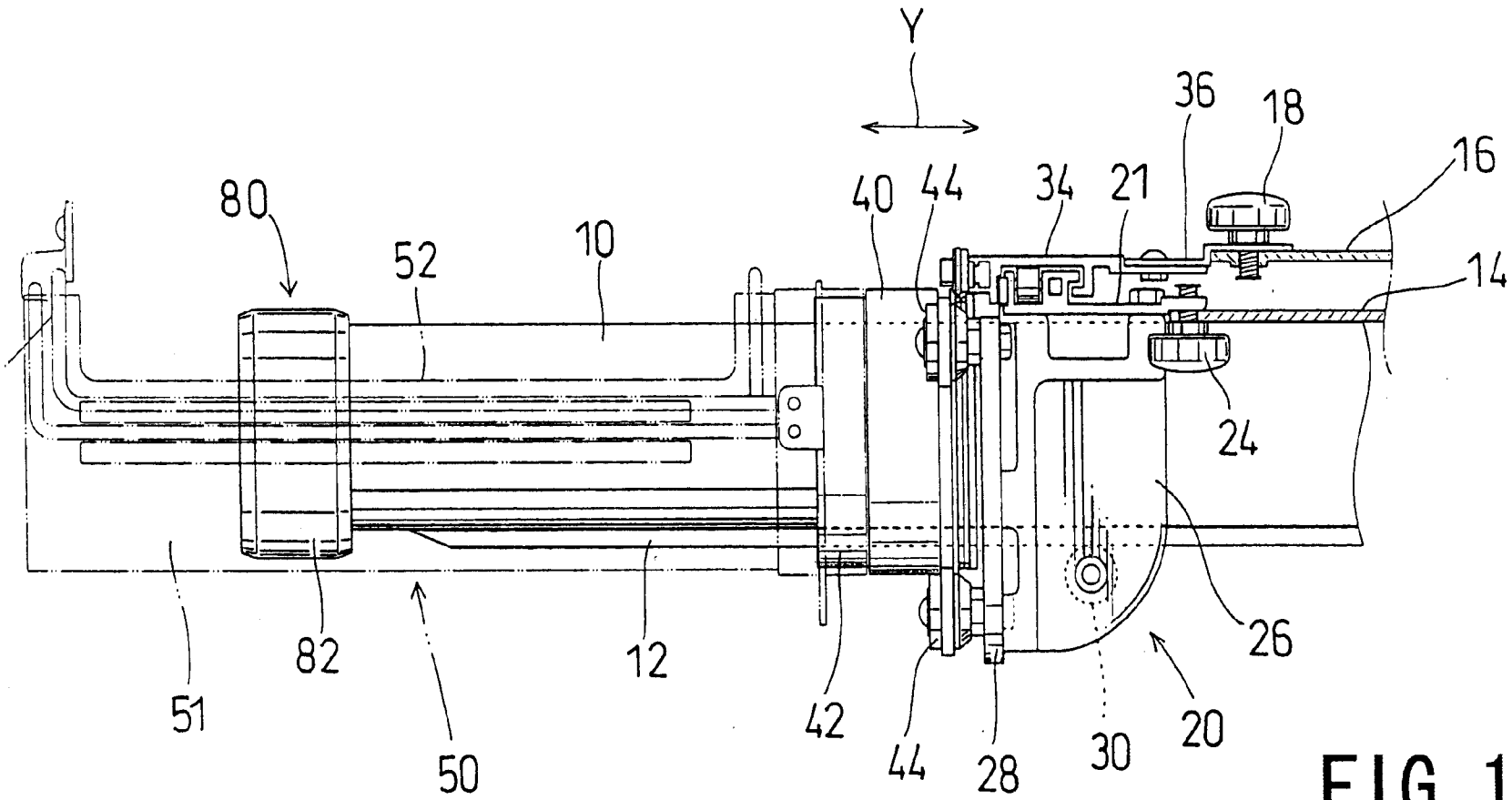
FIG. 10 is a side view showing the mounting state of a frame drive unit according to a second embodiment.
Figure 11:
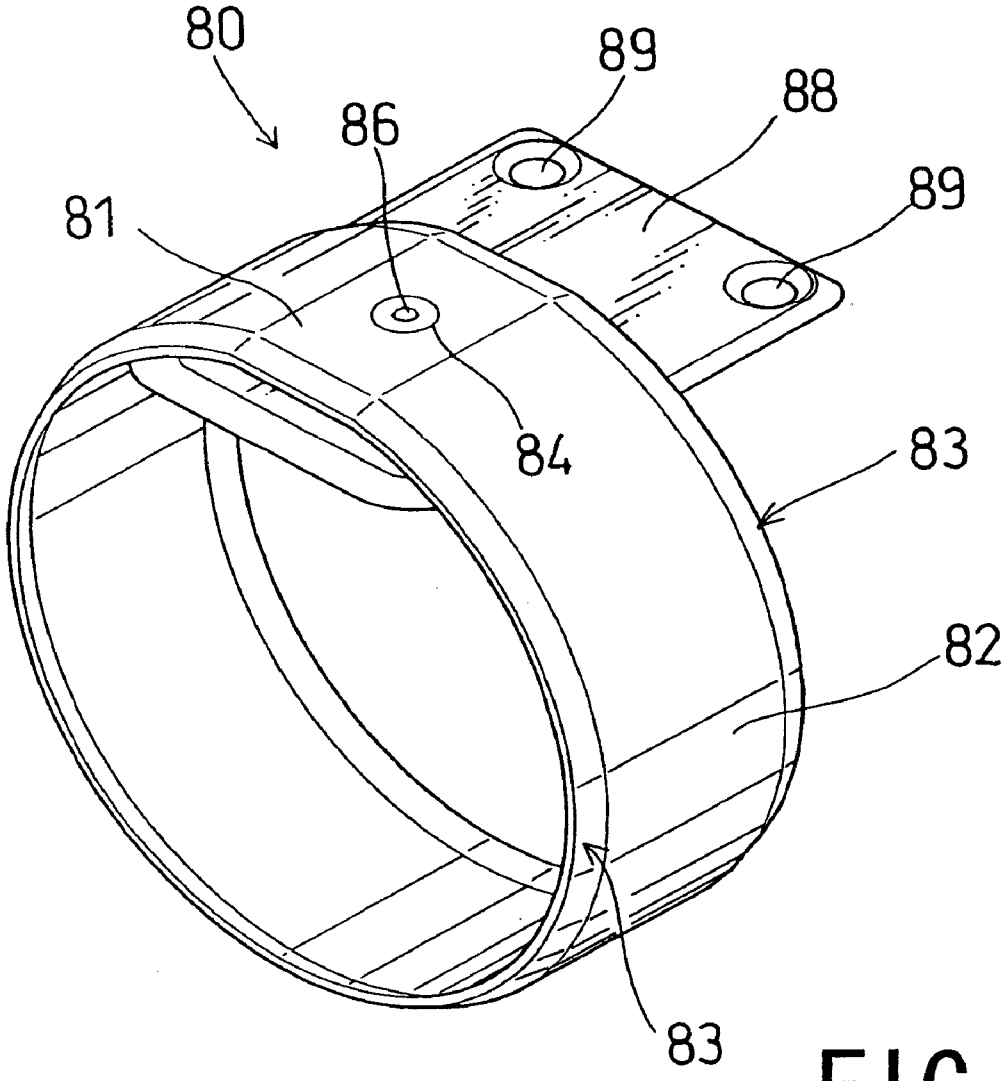
FIG. 11 is a perspective view showing a support member of the second embodiment in an enlarged scale.
Figure 12:
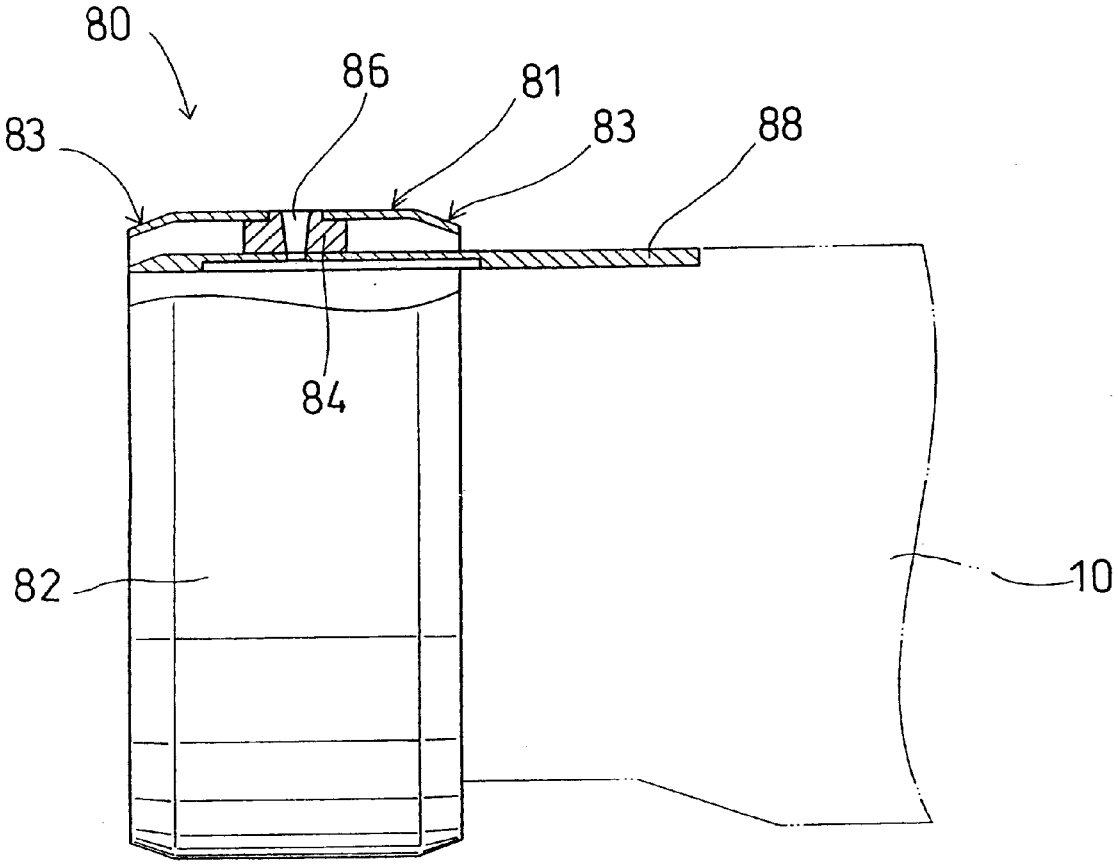
FIG. 12 is a side view of the support member of the second embodiment, with a part broken away.
Figure 13:
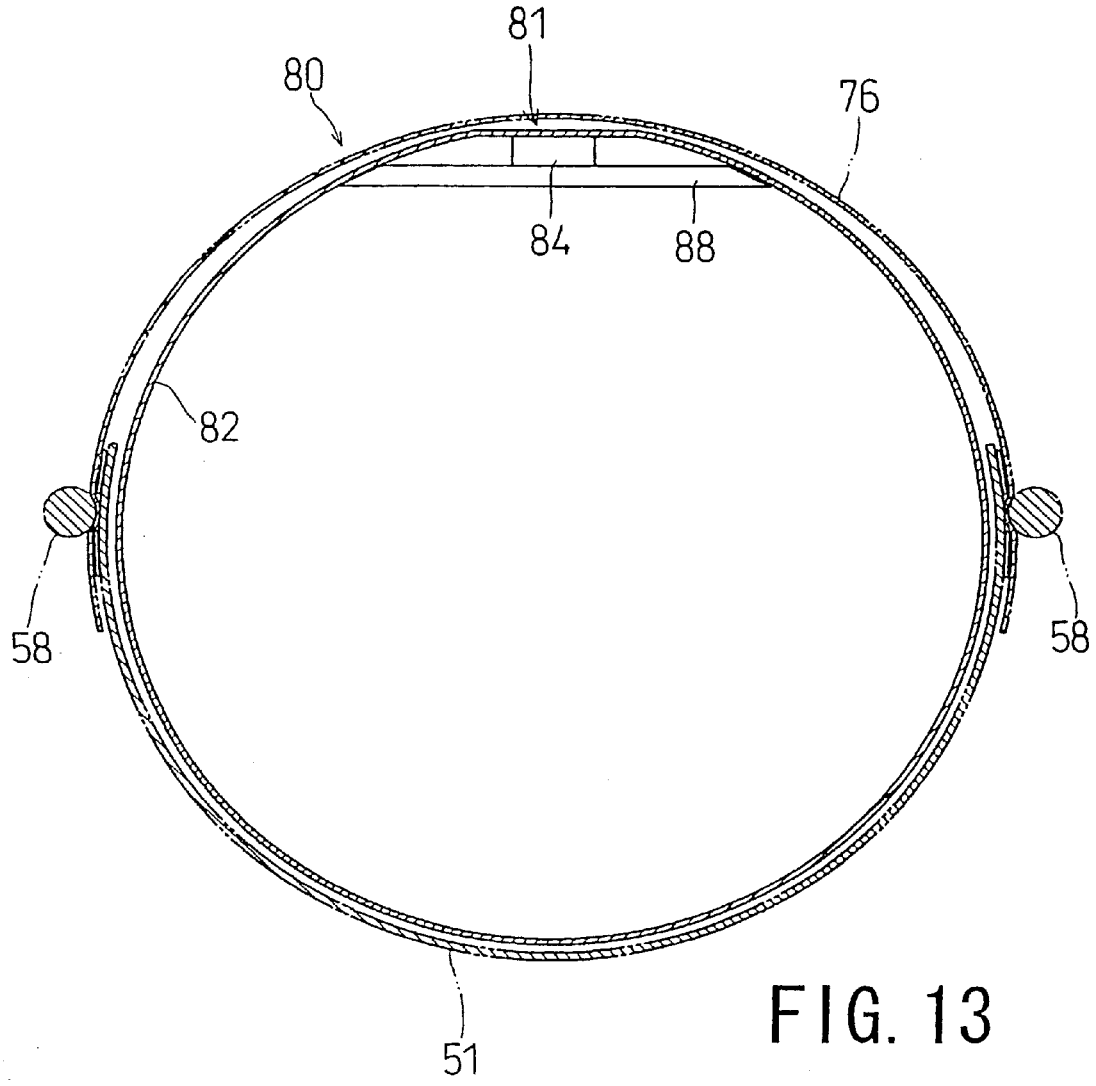
FIG. 13 is a sectional view of the support member shown in FIG. 11.

FIG. 10 is a side view showing the frame drive unit 20 mounted on the cylinder bed 10 of the second embodiment; FIG. 11 is a perspective view showing only the support 80 in an enlarged scale; FIG. 12 is a side view showing the support 80 with a part broken away; and FIG. 13 is a cross-sectional view of the support 80. As will be understood from these figures, the support 80 includes a cylindrical receiver portion 82 and a flat plate-like joint portion 88. A needle hole 86 is formed in a flattened portion 81 of the receiver portion 82, and the receiver portion 82 and the joint portion 88 are attached to each other by a boss portion 84, in which the needle hole 86 is formed (FIGS. 12 and 13). In addition, the outer peripheries of both respective ends of the receiver portion 82 are formed as tapered surfaces 83, so as to provide a guide for smooth movement of the tubular object in the direction of arrow Y.

The joint portion 88 may be secured to the upper surface of the cylinder bed 10 by inserting screws (not shown) into two respective threaded holes 89 formed in the rear end of the joint portion 88, and thereafter tightening the screws. In this state, the support 80 becomes integral with the cylinder bed 10. In addition, the receiver portion 82 is positioned to be substantially coaxial with the rotational axis of the receiver frame 51 and is disposed inside of the receiver frame 51. In addition, a small clearance may be formed between the outer peripheral surface of the receiver portion 82 and the inner peripheral surface of the receiver frame 51 so as to prevent frictional contact therebetween.

The interlining 76 may be placed on the frame 50 in the same manner as described in connection with the first embodiment and is shown in FIG. 13, in which the interlining 76 is disposed around the outer periphery of the receiver portion 82. Therefore, even if the interlining 76 sinks into the sewing window 52 during a frame driving operation, in which the frame 50 is driven to linearly move or rotate together with the tubular object and its interlining 76, the interlining 76 may be supported by the receiver portion 82 disposed around the needle hole 86 so as to have an arc-shaped configuration and may be suitably guided; therefore, a suitable sewing operation still can be performed.

As described above, the interlining 76 is adapted to support the tubular object so that the tubular object can be positioned as suitable as possible, even within the area of the sewing window 52; a paper material or a non-woven fabric made of resin, which has a suitable thickness and rigidity, may be used as the interlining material. Moreover, it may be advantageous to previously form perforations in the interlining 76, such that the perforations surround the area of the tubular object that is sewn, for example by an embroidery operation; in this case, the interlining 76 can be easily cut along the perforations after completion of the sewing operation.

With regard to the receiver portion 82 of the support 80, it is not required to be completely cylindrical in configuration, but instead it may have an arc-shaped configuration with a lower portion (a portion opposite to the needle hole 86) removed; in this case, the interlining 76 and the tubular object will not be caught when the interlining 76 and the tubular object slide along the receiver portion 82. In addition, a flat plate having a needle hole may be fixed to an upper surface of the cylinder bed 10, and receiver portions 82 having an arc-shaped may be fixed to the cylinder bed 10 at positions on both sides of the flat plate. In such a case, the boss portion having the needle hole must be omitted from the flat plate in order to prevent the boss portion from catching the interlining 76 and the tubular object. Thus, the receiver portion 82 may have an arc-shaped configuration that is either a completely continuous, annular configuration or that extends only along a predetermined angle.

If a flat plate having a needle hole is formed separately from the receiver portions 82, the receiver portions 82 can be removably connected to the cylinder bed 10 by means of screws or the like and a variety of receiver portions 82 can be prepared according to different sizes (widths) in the direction of arrow Y. Thus, different receiver portions 82 may be selectively used in response to the properties of the tubular objects or the interlinings 76, so that the tubular objects can be more properly mounted.

A third embodiment of the present invention will now be described with reference to FIG. 14. The third embodiment, as well as fourth to seventh embodiments that will be explained hereinbelow, relate to modifications of the frame 50.

Figure 14:
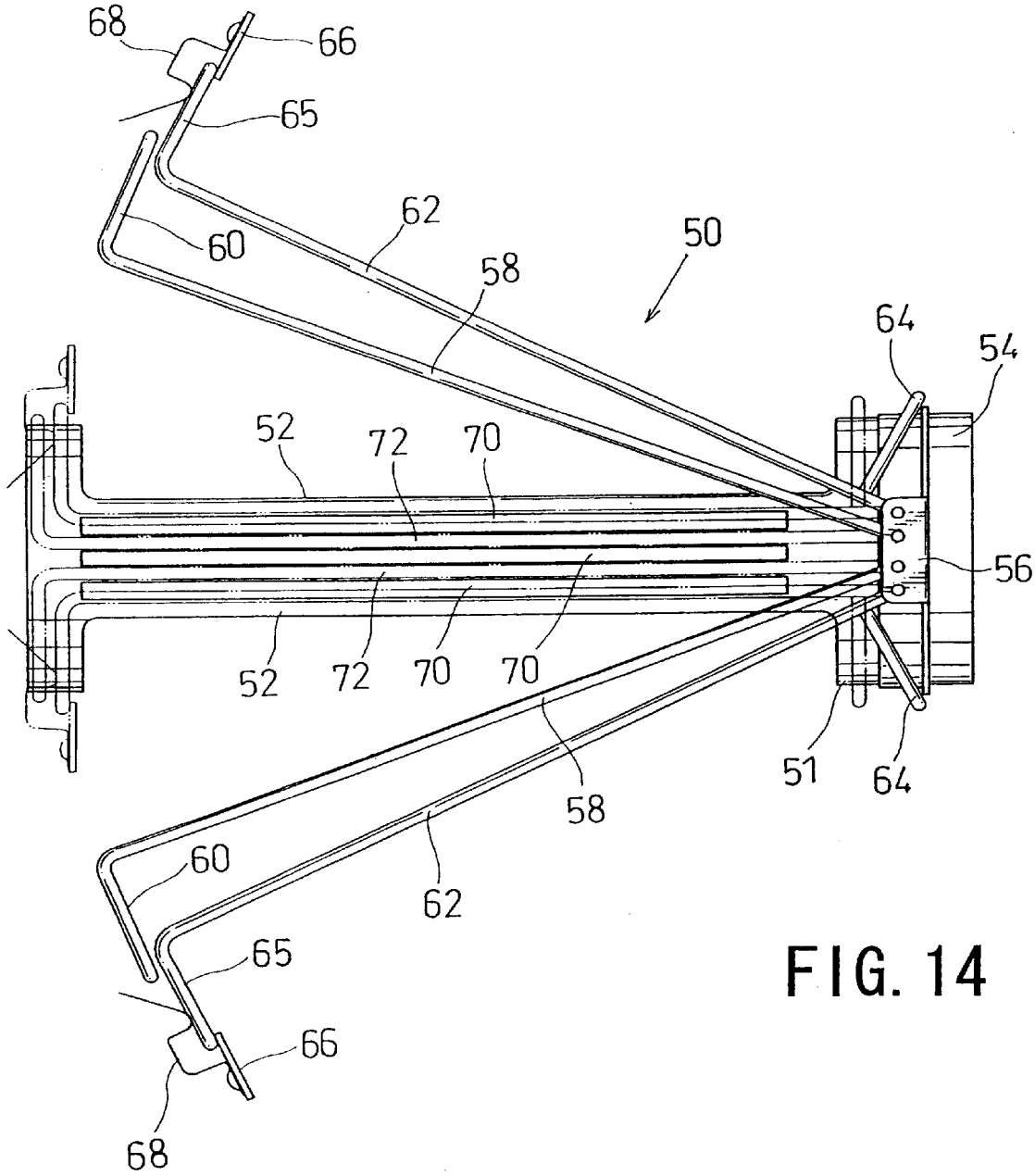
FIG. 14 is a side view showing a frame of a third embodiment.

FIG. 14 is a side view showing a frame 50 according to the third embodiment. In the third embodiment, sewing windows 52 are formed on both the upper and lower sides of receiver frame 51. Accordingly, presser frames 58 and 62 are disposed on each of the upper and lower sides; retainer plates 70 (or recesses 72) are associated with these frames and are provided in pairs on each of upper and lower sides. According to this arrangement, the embroidering operation or the like can be performed individually within each of the upper and lower sewing windows 52 without the need to reset the tubular object on the frame 50, thereby improving operation efficiency.

The fourth embodiment of the present invention will now be described with reference to FIGS. 15 and 16.

Figure 15:
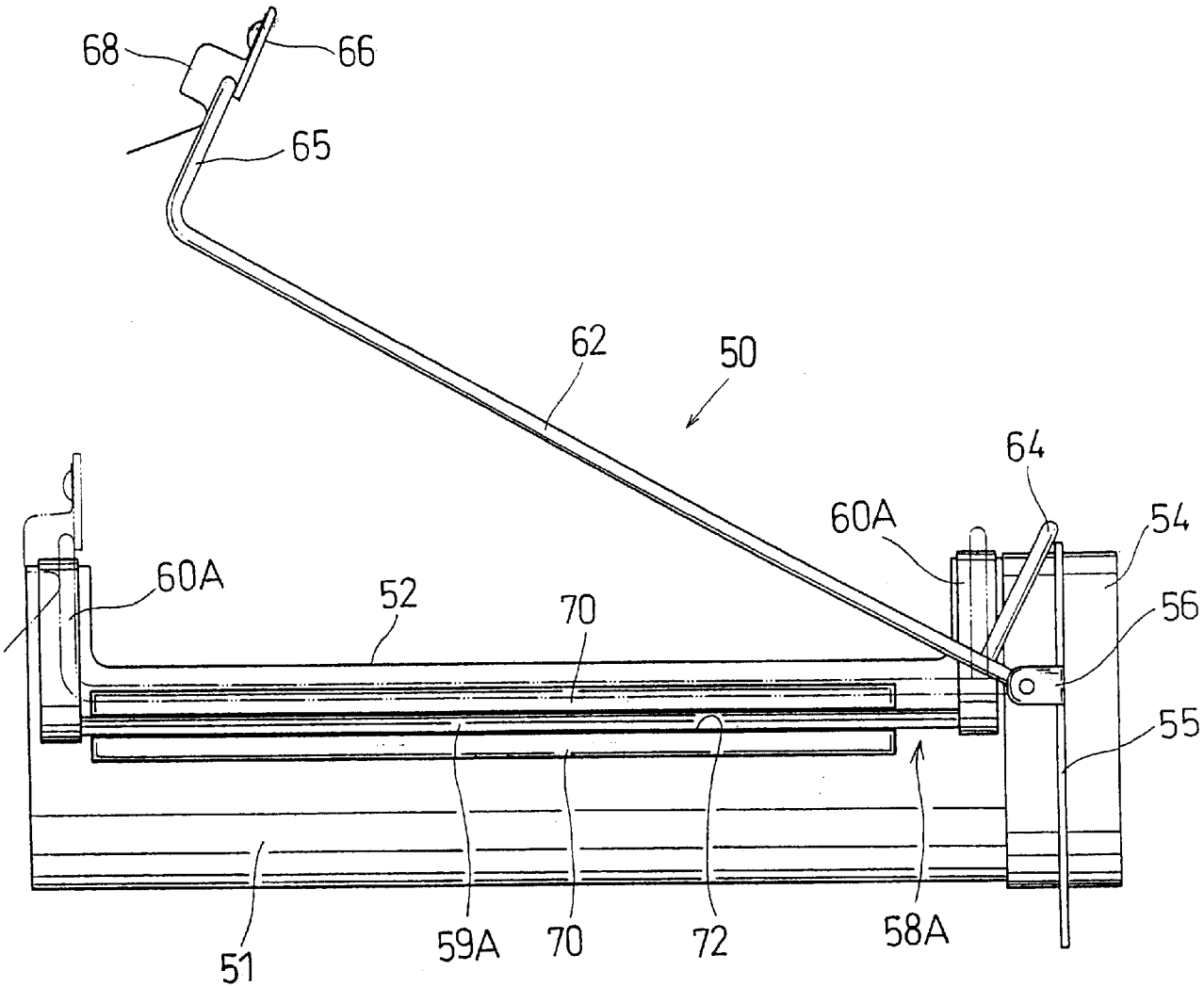
FIG. 15 is a side view showing a frame of a fourth embodiment.
Figure 16:
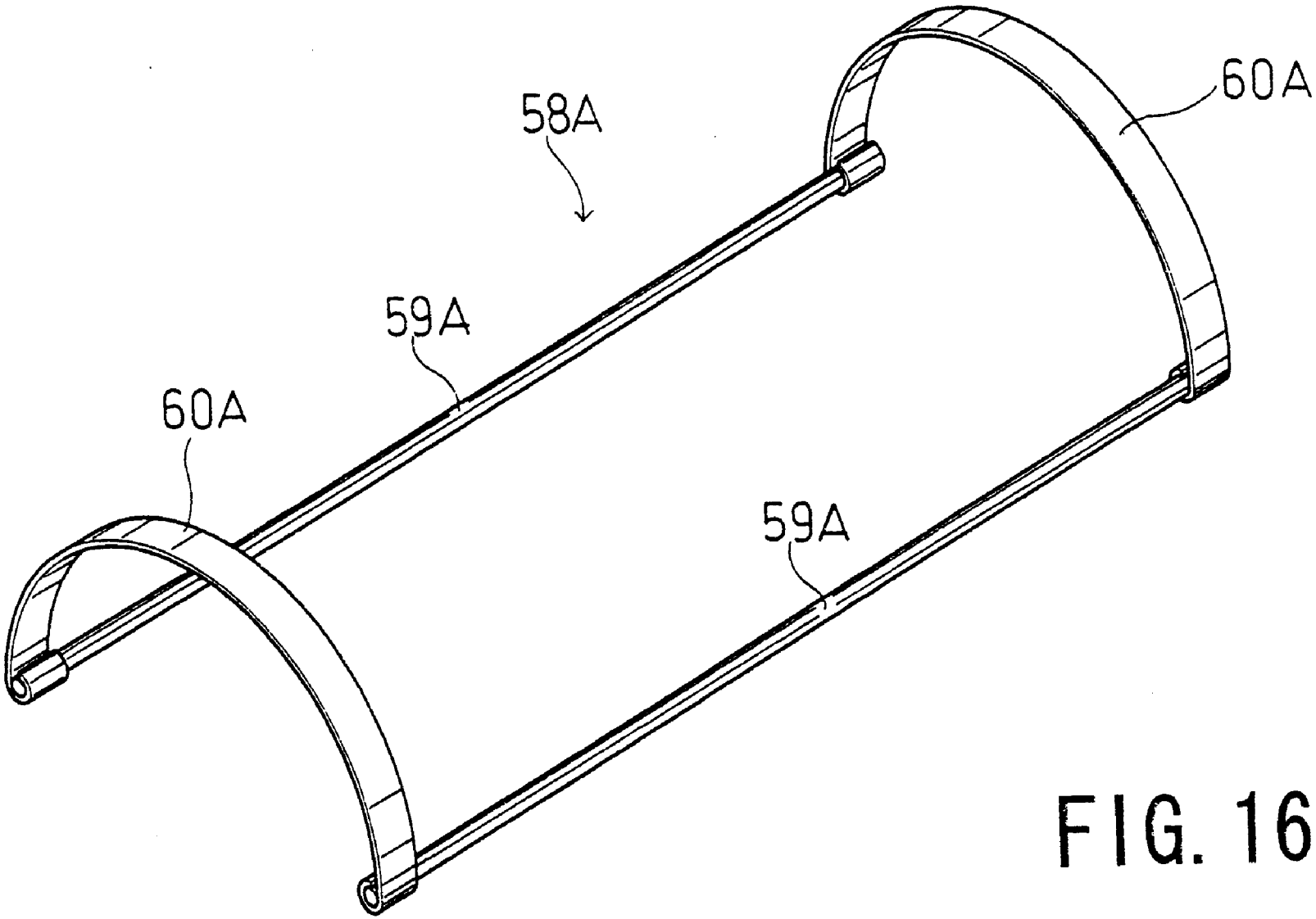
FIG. 16 is a perspective view showing a presser frame for interlinings of the fourth embodiment.

FIG. 15 is a side view of frame 50 according to the fourth embodiment and FIG. 16 is a perspective view showing only presser frame 58A for interlinings. Although receiver frame 51 and presser frame 62 for tubular objects of this fourth embodiment are the same as those of the first embodiment, the presser frame 58A for interlinings is removably mounted on the receiver frame 51. As will be understood from FIG. 8, the presser frame 58A has a construction, in which both sides of bars 59A are connected together with a pair of front and rear arc-shaped portions 60A. The bars 59A may be fitted into recesses 72 of the retainer plates 70 with both ends of the interlining clamped by the bars, so that the interlining can be retained.

Figure 17:
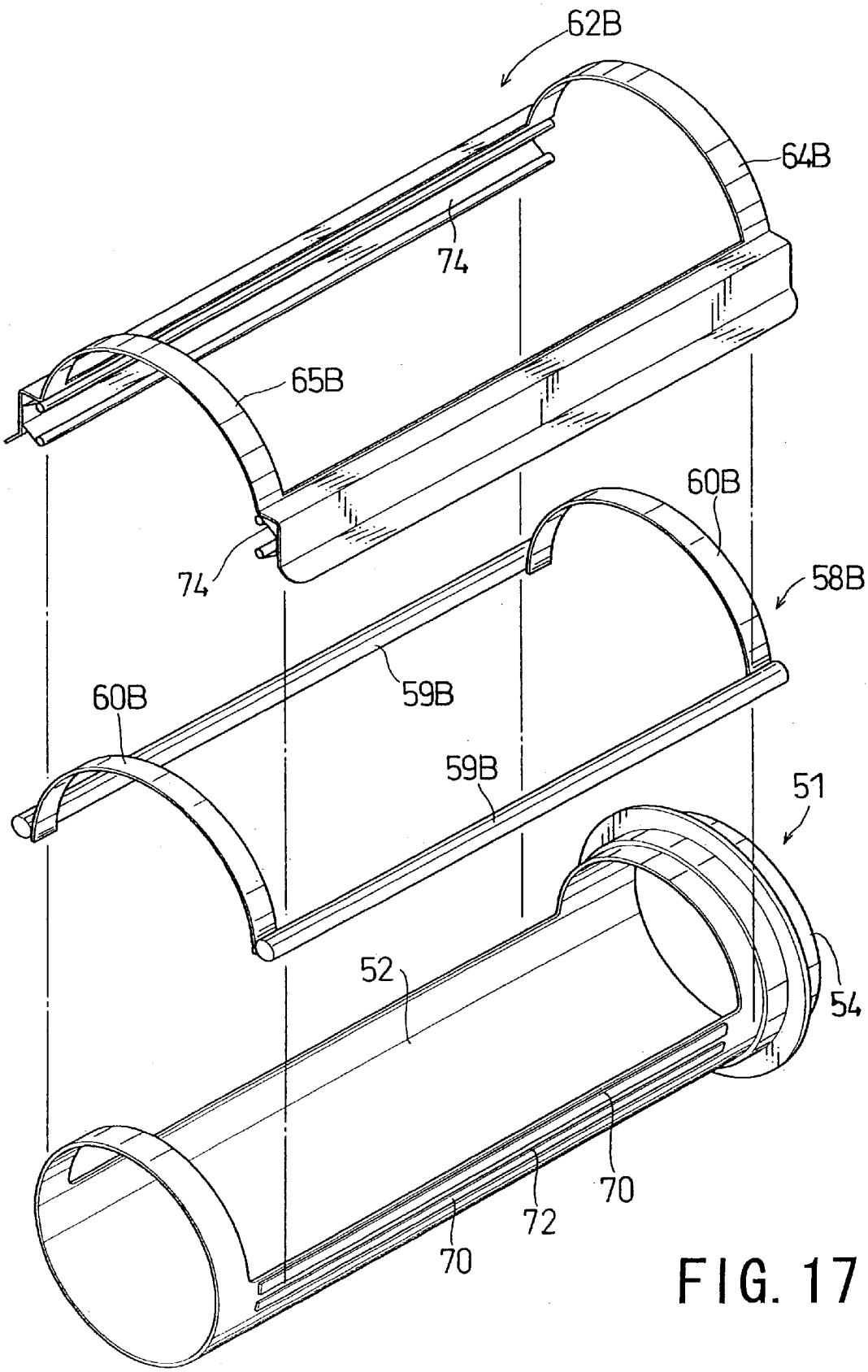
FIG. 17 is a perspective view showing a frame of a fifth embodiment, with a receiver frame and two presser frames of the frame being separated from each other.

The fifth embodiment will now be described with reference to FIG. 17, which shows a perspective view.

In this fifth embodiment, only receiver frame 51 is the same as the receiver frame 51 of the first embodiment; both presser frame 58B for interlinings and presser frame 62B for tubular objects are removably mounted on the receiver frame 51. Although the presser frame 58B for interlinings is similar to the presser frame 58A of the fourth embodiment, because both sides of the bars 59B are connected to a pair of front and rear arc-shaped portions 60B, the bars 59B are disposed outside of the arc-shaped portions 60B, and rods having a diameter greater than the diameter of the bars 59A are used as the materials for the bars 59A.

The presser frame 62B for tubular objects is formed by press molding a plate material and both side portions are integrated with arc-shaped portions 64B and 65B; engaging members 74 are secured to the inside of both side portions and extend along the entire length thereof. The engaging members 74 are adapted to engage the respective bars 59B on both sides of the presser frame 58B. Therefore, in the case of the presser frame 58B for interlinings, both sides of the bars 59B may be fitted into the recesses 72 that are formed between the retainer plates 70, with both ends of the interlining clamped by the bars in the same manner as the fourth embodiment. Thereafter, both sides of the engaging members 74 may engage the bars 59B, with the tubular object clamped by the engaging members 74.

The sixth embodiment will now be described with reference to FIGS. 18 to 21.

Figure 18:
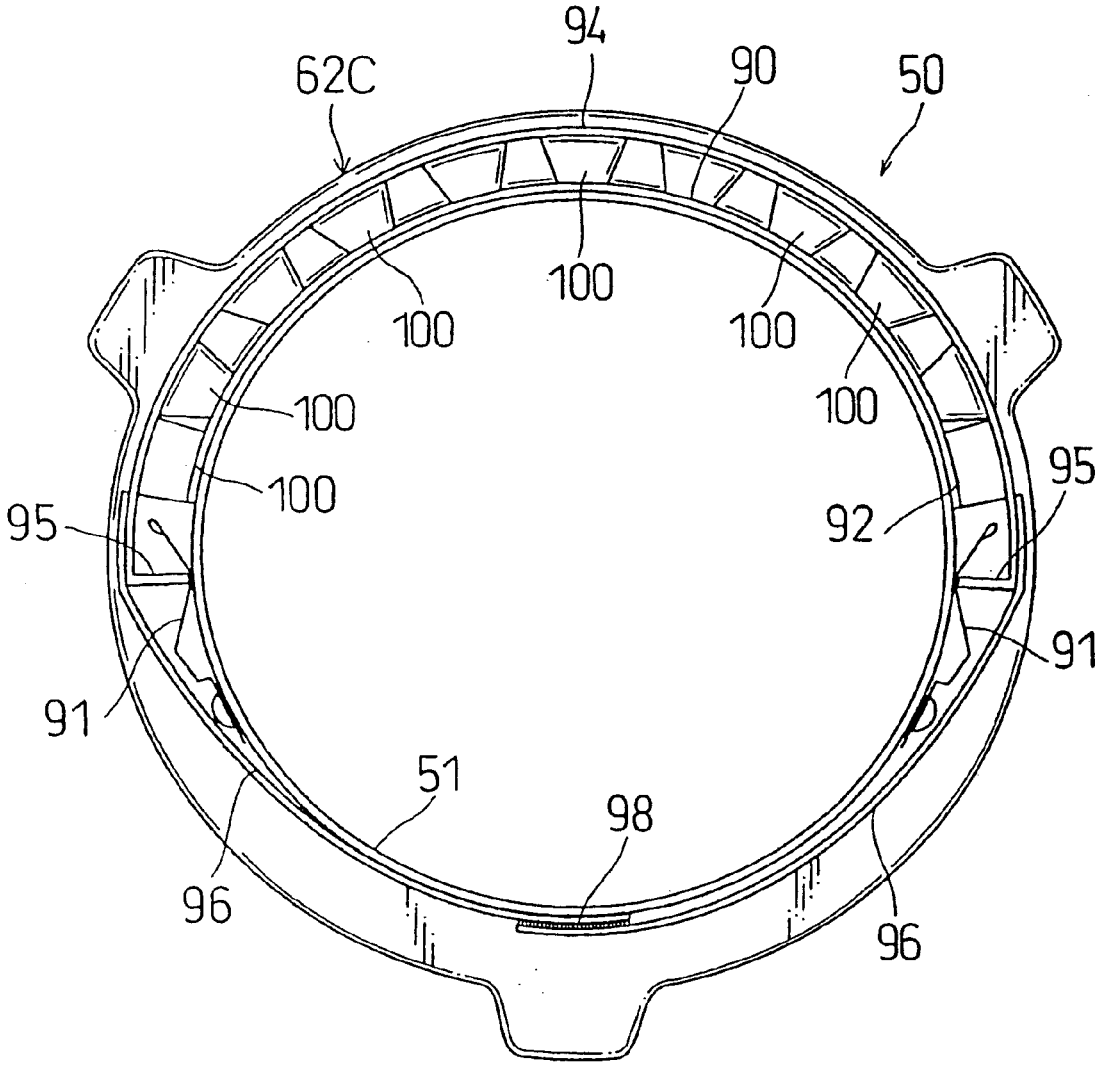
FIG. 18 is a front view-showing a frame of a sixth embodiment.
Figure 19:
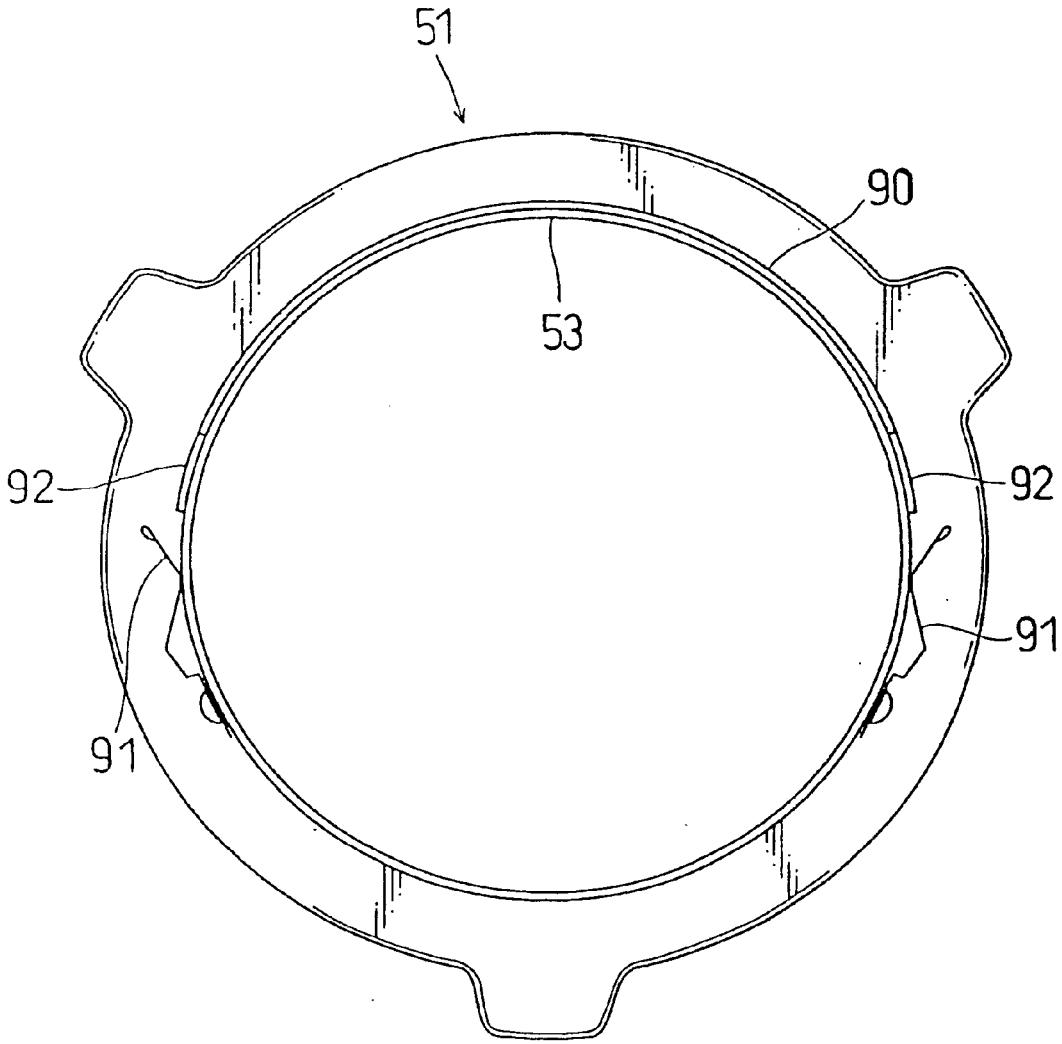
FIG. 19 is a front view showing only the receiver frame that is shown in FIG. 18.
Figure 20:
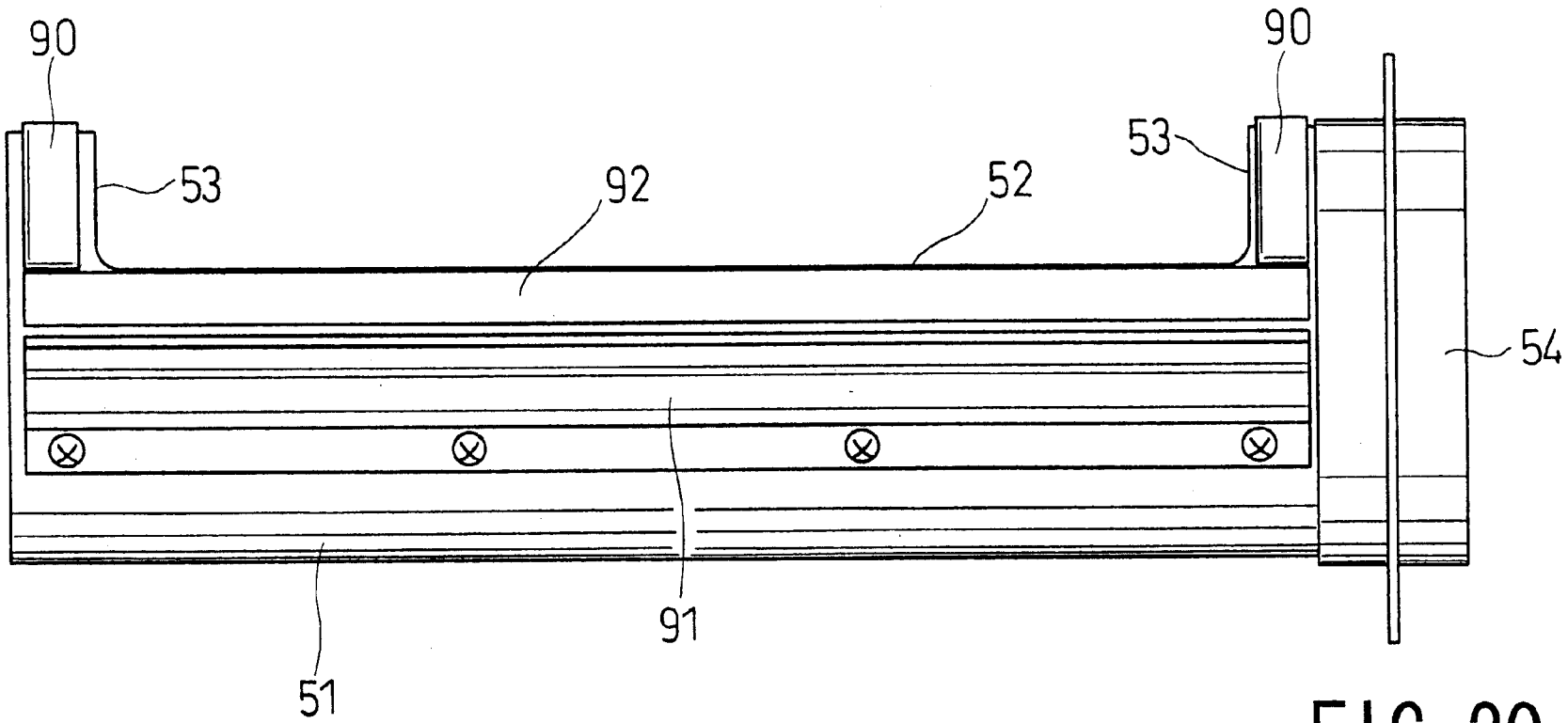
FIG. 20 is a side view of FIG. 19.
Figure 21:
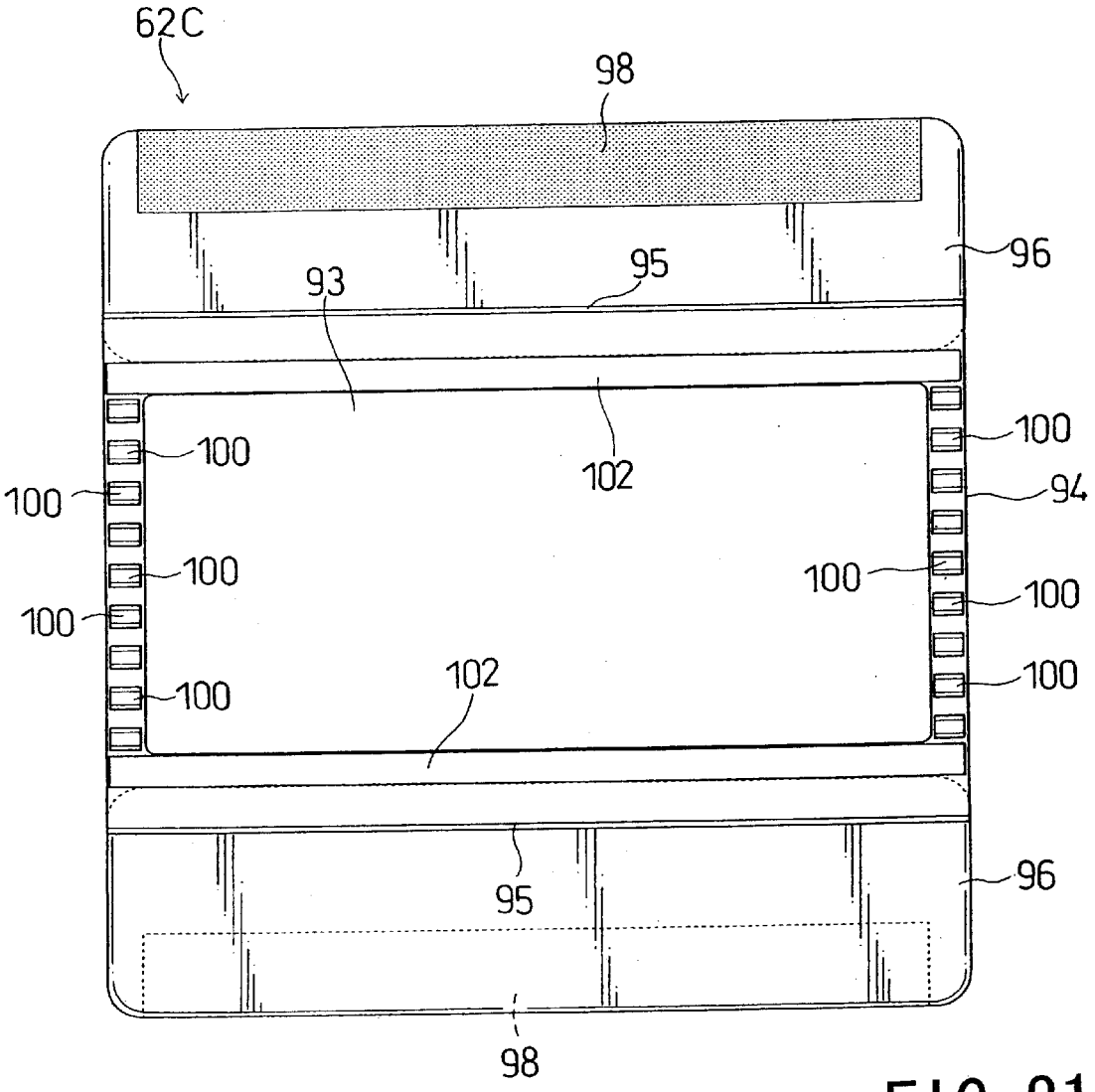
FIG. 21 is a plan view showing only the presser frame of the sixth embodiment.

FIG. 18 is a front view showing frame 50 of the sixth embodiment; FIG. 19 is a front view showing only receiver frame 51 of the same embodiment; FIG. 20 is a side view showing only the receiver frame 51; and FIG. 21 is a plan view showing only presser frame 62C of the sixth embodiment. As will be understood from these figures, spring members 91 are secured to both sides of the sewing window 52 of the receiver frame 51 and extend substantially along the length of the receiver frame 51, with the exception of the retainer 54. This embodiment is constructed such that the interlining can be retained by the receiver frame 51 by slidably inserting both ends of the interlining between the spring members 91 and the outer peripheral surface of the receiver frame 51; therefore, a presser frame for interlinings is omitted. In addition, slip prevention members 90 and 92, which are made of rubber strips or the like, are respectively secured by adhesion to annular portions 53 disposed on both front and rear sides of the sewing window 52 and on both side edges of the sewing window 52.

Further, as shown in FIG. 21, the presser frame 62C includes a flexible frame 94 having a window 93, which is sized to correspond to the sewing window 52, and connecting strips 96 that are joined to both sides of the flexible frame 94 by adhesion. The flexible frame 94 may be formed from a flexible stain-less steel plate or the like, and synthetic leather may be used as the material of the connecting strips 96.

A plurality of presser members 100, which have a trapezoidal cross-section, are bonded at predetermined intervals, by adhesive around the window 93 of the flexible frame 94, to the area corresponding to the front and rear slip prevention members 90 of the receiver frame 51; presser members 102 are bonded by adhesive to the area corresponding to the slip prevention members 92 and extend continuously in the lengthwise direction. In addition, two flat fasteners 98 (brand name "Magic Tape") are bonded by adhesive to the respective ends of the connecting strips 96.

In order to use the frame 50 of the sixth embodiment, an interlining of a tubular object is first placed on the receiver frame 51 so as to cover the sewing window 52, and both ends of the interlining are slidably inserted between the spring plates 91 on both sides and the outer peripheral surface of the receiver frame 51, so that the interlining can be retained. Then, the tubular object is placed on the outer periphery of the receiver frame 51; thereafter, the presser frame 62C is wound around the outer periphery of the receiver frame 51 or the tubular object, and the connecting strips 96 are connected to each other by means of the flat fasteners 98.

In this state, the pressing members 100 and 102 of the flexible frame 94 oppose the respective slip prevention members 90 and 92, so that the interlining and the tubular object are clamped between them and can be held without permitting slippage. In addition, as shown in FIG. 18, both ends of the flexible flame 94 are bent to form projections 95 that are pressed against their respective spring members 91, so that the retaining force applied to the interlining can be further increased.

Figure 22:
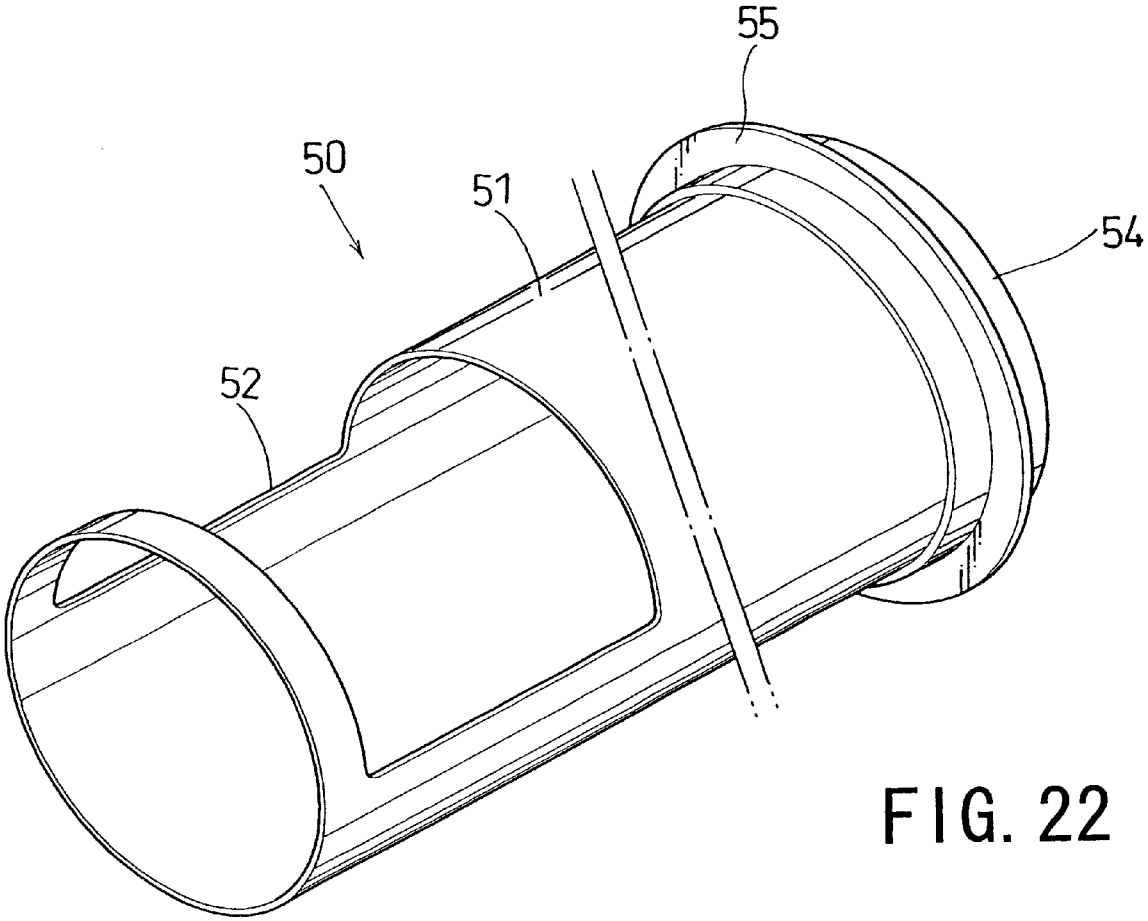
FIG. 22 is a perspective view showing a frame of a seventh embodiment.

Finally, the seventh embodiment of the present invention will now be explained with reference to FIG. 22.

This second embodiment is directed to frame 50, on which tubular objects are placed, having only receiver frame 51. Thus, small tubular objects may be retained by placing them only on the outer periphery of the receiver frame 51, depending upon the configurations or properties of the materials of the tubular objects or articles to be sewn. For example, if a tubular object has a diameter in a free state that is smaller than the outer diameter of the receiver frame 51 and if the tubular object is elastic, the tubular object may be retained only by its elastic restoring forces. If the tubular object has a diameter that is slightly greater than the outer diameter of the receiver frame 51, the tubular object may be retained by fixing it at forward and rearward positions of the sewing window 52 by means of rubber rings or the like.

Of course, with regard to the above embodiments of the frame body 50, the technique of the third embodiment as described with reference to FIG. 14, or the technique to enable individual embroidery or similar operations on both sides of the periphery of the receiver frame 51 without the need to reset the tubular objects or the interlinings on the frame 50 may be used in combination with the techniques of the fourth to sixth embodiments.

Although the present invention has been described in connection with the preferred embodiments, it should be understood that modifications and variations may be easily made without departing from the sprit of the present invention that is defined in the attached claims.

What is claimed is:

1. A sewing machine comprising:

a cylinder bed arranged and constructed to be disposed within a tubular object during a sewing operation, a cylindrical drive ring arranged and constructed to be reciprocally rotated around the cylinder bed and to be linearly reciprocally driven along a longitudinal axis of the cylinder bed, wherein an outer periphery of the cylindrical drive ring is rotatably supported in at least three positions and an inner periphery of the cylinder ring is not supported, wherein an outer periphery of the cylinder bed substantially conforms to the inner periphery of the cylindrical drive ring, and a cylindrical frame arranged and constructed to retain the tubular object, the cylindrical frame being mounted on the cylindrical drive ring.

2. A sewing machine as in claim 1, wherein the outer periphery of the cylinder bed substantially conforms to the inner periphery of the cylindrical drive ring.

3. A sewing machine as in claim 1, wherein at least a portion of the outer periphery of the cylinder bed is disposed as close as possible to the cylindrical drive ring.

4. A sewing machine as in claim 1, further comprising three rollers rotatably supporting the outer periphery of the cylindrical drive ring.

5. A sewing machine as in claim 4, wherein the three rollers are rotatably supported on a plate that is fixed to the cylinder bed.

6. A sewing machine as in claim 1, wherein the cylinder bed includes a shuttle disposed therein, a first needle hole defined in a position opposing the shuttle, and further comprising a substantially cylindrical support coupled to a terminal end of the cylinder bed, the substantially cylindrical support comprising a second needle hole substantially aligned with the first needle hole, wherein the substantially cylindrical support is arranged and constructed to receive the tubular object around the entire outer periphery of the substantially cylindrical support.

7. A sewing machine as in claim 6, further comprising a joint portion coupling the substantially cylindrical support to the terminal end of the cylinder bed.

8. A sewing machine as in claim 6, wherein the substantially cylindrical support comprises a tapered edge that provides a smooth guide for mounting the tubular object on the cylindrical frame.

9. A sewing machine as in claim 1, wherein the cylindrical frame includes:

a tubular receiver frame arranged and constructed to receive the tubular object, and a sewing window that opens within the receiver frame over a predetermined range, wherein the frame is arranged and constructed to individually retain the tubular object and an interlining attached to the tubular object at the sewing window.

10. A sewing machine as in claim 9, wherein two sewing windows are defined within the receiver frame, and the frame is arranged and constructed to individually retain the tubular object and the interlining at each of the sewing windows.

11. A sewing machine as in claim 9, wherein the cylinder frame further includes a first presser frame arranged and constructed to retain the interlining against the receiver frame and a second presser frame arranged and constructed to retain the tubular object.

12. A sewing machine as in claim 11, wherein one end of each of the first and second presser frames is pivotally connected to the receiver frame, the second presser frame is arranged and constructed to be laid over the first presser frame, and the first presser frame further includes a lock member arranged and constructed to releasably engage the receiver frame.

13. A sewing machine as in claim 11, wherein the first presser frame is arranged and constructed to be placed on the receiver frame with the interlining retained between the first presser frame and the receiver frame, and the second presser frame is arranged and constructed to be overlaid on the first presser frame with the tubular object retained between the first and second presser frames.

14. A sewing machine as in claim 9, wherein the receiver frame further includes a spring arranged and constructed to retain the interlining, and an auxiliary presser frame wound around the receiver frame so as to be placed on the receiver frame and to retain the tubular object.

15. A sewing machine as in claim 14, wherein the auxiliary presser frame includes a flexible frame having a window that is sized to correspond to the sewing window of the receiver frame, and further comprising connecting strips that are attached to both sides of the flexible frame.

16. A sewing machine as in claim 15, further comprising a slip prevention member disposed around the sewing window of the receiver frame, and a pressing member disposed around the window of the flexible frame so as to correspond to the slip prevention member disposed around the sewing window.

17. A sewing machine comprising:

a cylinder bed arranged and constructed to receive a tubular object, the cylinder bed comprises a shuttle disposed therein and a first needle hole defined in a position opposing the shuttle, a cylindrical drive ring arranged and constructed to be reciprocally rotated around the cylinder bed and to be linearly reciprocally driven along a longitudinal axis of the cylinder bed, wherein an outer periphery of the cylindrical drive ring is rotatably supported in at least three positions, a cylindrical frame arranged and constructed to retain the tubular object, the cylindrical frame being fixedly mounted on the cylindrical drive ring, and a substantially cylindrical support coupled to a terminal end of the cylinder bed, the substantially cylindrical support comprising a second needle hole substantially aligned with the first needle hole, wherein the substantially cylindrical support is arranged and constructed to receive the tubular object around the entire outer periphery of the substantially cylindrical support.

18. A sewing machine as in claim 17, wherein a tapered edge is defined on at least an outer edge of the substantially cylindrical support.

19. A sewing machine as in claim 18, wherein a tapered edge is also defined on an inner edge of the substantially cylindrical support.

20. A sewing machine comprising:

a cylinder bed arranged and constructed to receive a tubular object, a cylindrical drive ring arranged and constructed to be reciprocally rotated around the cylinder bed and to be linearly reciprocally driven along a longitudinal axis of the cylinder bed, wherein an outer periphery of the cylindrical drive ring is rotatably supported in at least three positions, and a cylindrical frame arranged and constructed to retain the tubular object, the cylindrical frame being fixedly mounted on the cylindrical drive ring, wherein the cylindrical frame includes:

a tubular receiver frame arranged and constructed to receive the tubular object, and a sewing window defined within the receiver frame over a predetermined range, wherein the cylindrical frame is arranged and constructed to individually retain the tubular object and an interlining attached to the tubular object at the sewing window.

21. A sewing machine as in claim 20, wherein the cylinder frame further includes a first presser frame arranged and constructed to retain the interlining against the receiver frame and a second presser frame arranged and constructed to retain the tubular object.

22. A sewing machine as in claim 21, wherein one end of each of the first and second presser frames is pivotally connected to the receiver frame, the second presser frame is arranged and constructed to be laid over the first presser frame, and the first presser frame further includes a lock member arranged and constructed to releasably engage the receiver frame.

23. A sewing machine as in claim 22, wherein the first presser frame is arranged and constructed to be placed on the receiver frame with the interlining retained between the first presser frame and the receiver frame, and the second presser frame is arranged and constructed to be overlaid on the first presser frame with the tubular object retained between the first and second presser frames.

24. A cylindrical frame for retaining a tubular object comprising an interlining during a sewing operation, the cylindrical frame being arranged and constructed to be fixedly, mounted on a cylindrical drive ring of a sewing machine, comprising:

a tubular receiver frame arranged and constructed to receive the tubular object, wherein a sewing window is defined within the receiver frame over a predetermined range, a first presser frame arranged and constructed to retain the interlining against the receiver frame, wherein the interlining is interleaved between the receiver frame and the first presser frame, and a second presser frame arranged and constructed to retain the tubular object against the first presser frame.

25. A cylindrical frame as in claim 24, wherein one end of each of the first and second presser frames is pivotally connected to the receiver frame, the second presser frame is arranged and constructed to be laid over the first presser frame, and the first presser frame further includes a lock member arranged and constructed to releasably engage the receiver frame.

26. A cylindrical frame as in claim 24, wherein the receiver frame further includes a spring arranged and constructed to retain the interlining, and an auxiliary presser frame wound around the receiver frame so as to be placed on the receiver frame and to retain the tubular object.

27. A cylindrical frame as in claim 26, wherein the auxiliary presser frame includes a flexible frame having a window that is sized to correspond to the sewing window, and further comprising connecting strips that are attached to both sides of the flexible frame.

28. A cylindrical frame as in claim 27, further comprising a slip prevention member disposed around the sewing window, and a pressing member disposed around the window of the flexible frame so as to correspond to the slip prevention member disposed around the sewing window.

29. A sewing machine comprising:

a cylinder bed arranged and constructed to be disposed within a tubular object during a sewing operation, a cylindrical drive ring arranged and constructed to be reciprocally rotated around the cylinder bed and to be linearly reciprocally driven along a longitudinal axis of the cylinder bed, wherein an outer periphery of the cylindrical drive ring is rotatably supported in at least three positions and an inner periphery of the cylinder ring is not supported, three rollers rotatably supporting the outer periphery of the cylindrical drive ring, and a cylindrical frame arranged and constructed to retain the tubular object, the cylindrical frame being mounted on the cylindrical drive ring.

* * * * *